US010604866B2

(12) United States Patent
Masuda et al.

(10) Patent No.: US 10,604,866 B2
(45) Date of Patent: Mar. 31, 2020

(54) SEA-ISLAND COMPOSITE FIBER, COMPOSITE ULTRA-FINE FIBER, AND FIBER PRODUCT

(71) Applicant: Toray Industries, Inc, Tokyo (JP)

(72) Inventors: Masato Masuda, Mishima (JP); Tatsuya Hanawa, Otsu (JP); Joji Funakoshi, Otsu (JP)

(73) Assignee: Toray Industries, Inc., Tokyo (JP)

( * ) Notice: Subject to any disclaimer, the term of this patent is extended or adjusted under 35 U.S.C. 154(b) by 396 days.

(21) Appl. No.: 15/121,171

(22) PCT Filed: Feb. 18, 2015

(86) PCT No.: PCT/JP2015/054411
§ 371 (c)(1),
(2) Date: Aug. 24, 2016

(87) PCT Pub. No.: WO2015/129519
PCT Pub. Date: Sep. 3, 2015

(65) Prior Publication Data

US 2017/0016147 A1 Jan. 19, 2017

(30) Foreign Application Priority Data

Feb. 25, 2014 (JP) ..... 2014-034212

(51) Int. Cl.
*D01D 5/36* (2006.01)
*D04H 1/541* (2012.01)

(52) U.S. Cl.
CPC ..... *D01D 5/36* (2013.01); *D04H 1/541* (2013.01)

(58) Field of Classification Search
CPC ..... D01D 5/36; D04H 1/541
USPC ..... 428/373–396
See application file for complete search history.

(56) References Cited

U.S. PATENT DOCUMENTS 4,557,972 A * 12/1985 Okamoto ..... D01F 8/14 264/172.13
2005/0260911 A1* 11/2005 Ochi ..... D01D 5/247 442/189

FOREIGN PATENT DOCUMENTS

| | | | |
|---|---|---|---|
| JP | 04-194013 | A | 7/1992 |
| JP | 05-222668 | A | 8/1993 |
| JP | 2001-131837 | A | 5/2001 |
| JP | 2003-213526 | A | 7/2003 |

(Continued)

OTHER PUBLICATIONS

Machine translation of JP 2005133250 A, original provided in IDS. (Year: 2019).*

(Continued)

*Primary Examiner* — Jeremy R Pierce
(74) *Attorney, Agent, or Firm* — DLA Piper LLP (US)

(57) ABSTRACT

A sea-island composite fiber in which island components are interspersed in a sea component on a fiber cross-section, wherein the island components have a composite structure formed with two or more different polymers joined together, and the ratio (L/D) of the length (L) of the joint section of the island component and the diameter (D) of the composite island component is 0.1 to 10.0. The sea-island composite fiber has satisfactory high-order processability, and therefore can be produced with high productivity and quality using existing equipment, and thin fibers obtained by removing the sea component have functions of structure control while having an excellent tactile impression.

8 Claims, 5 Drawing Sheets

(56) References Cited

FOREIGN PATENT DOCUMENTS

| | | | | |
|---|---|---|---|---|
| JP | 2005-133250 | A | | 5/2005 |
| JP | 2005133250 | A | * | 5/2005 |
| JP | 2005163233 | A | * | 6/2005 |
| JP | 2007-100243 | A | | 4/2007 |
| JP | 2011-157646 | A | | 8/2011 |
| WO | 2013/021809 | A1 | | 2/2013 |

OTHER PUBLICATIONS

An English translation to JP 2005-163233 to Nishimura obtained from the European Patent Office website. (Year: 2005).*
An English translation to JP 2005-133250 to Ochi obtained from the European Patent Office website. (Year: 2005).*

* cited by examiner

Fig. 1(a)
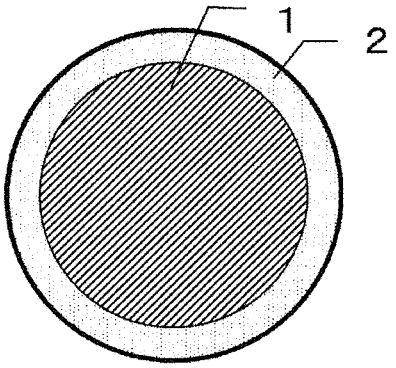
Fig. 1(b)
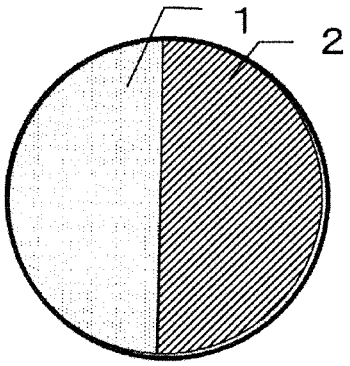
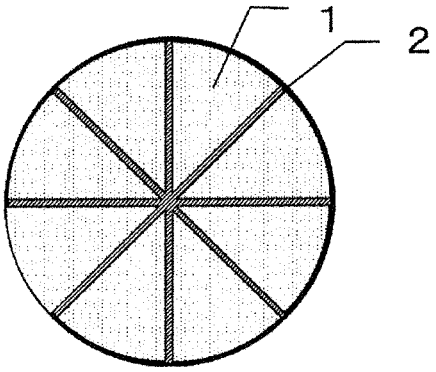
Fig. 1(c)
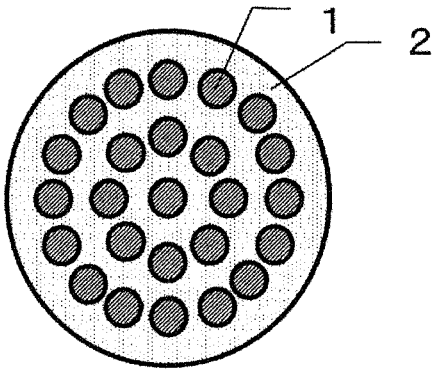
Fig. 1(d)

[Fig. 2]
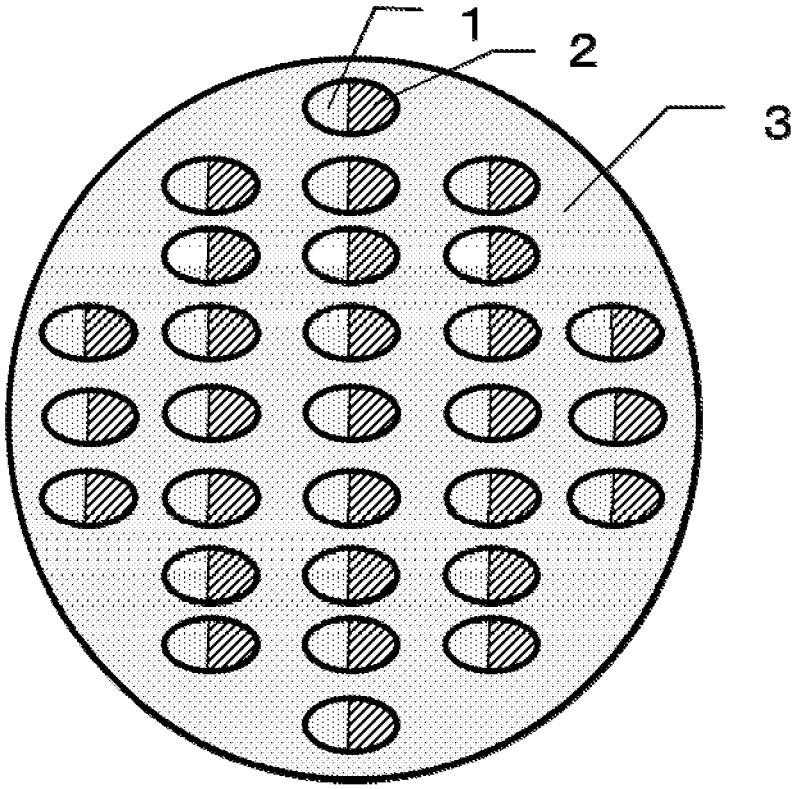

[Fig. 3]
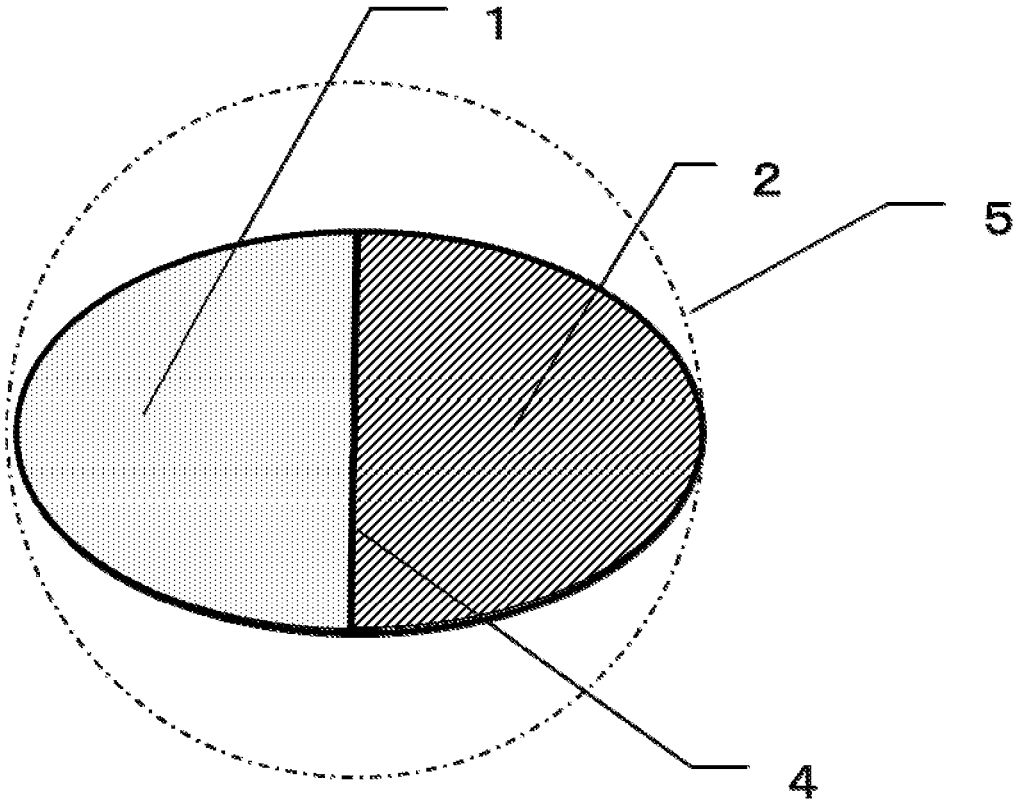

Fig. 4(a)
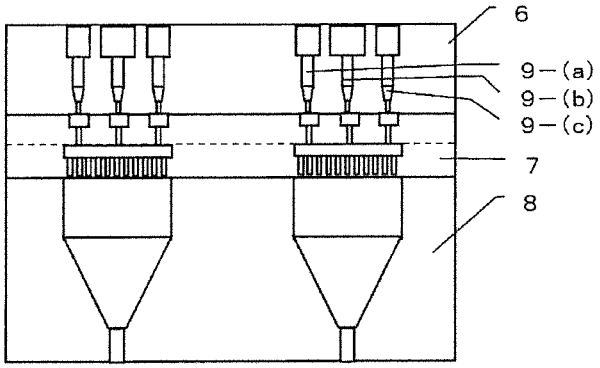
Fig. 4(c)
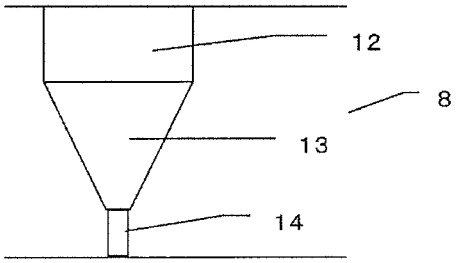
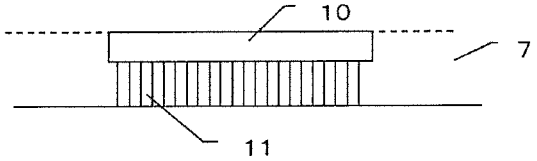
Fig. 4(b)

Fig. 5(a)
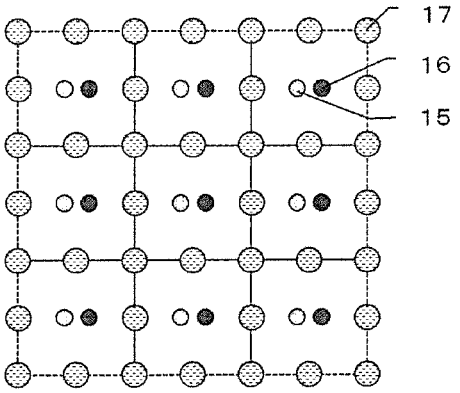
Fig. 5(b)
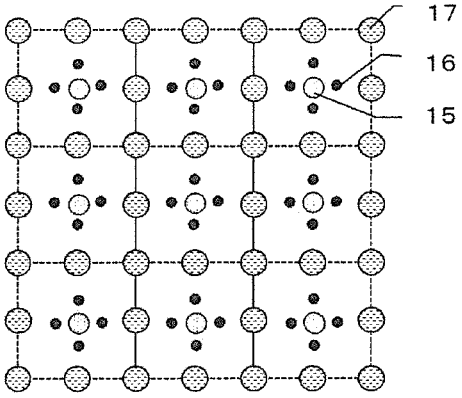
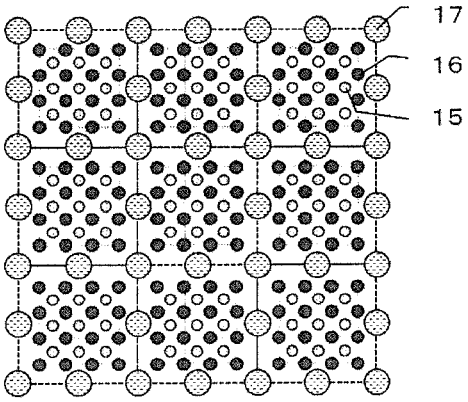
Fig. 5(c)

SEA-ISLAND COMPOSITE FIBER, COMPOSITE ULTRA-FINE FIBER, AND FIBER PRODUCT

TECHNICAL FIELD

This disclosure relates to a sea-island composite fiber including island components and a sea component surrounding the island components on a fiber cross-section in a direction vertical to the fiber axis, the island component including two or more polymers. The disclosure also relates to a conjugate thin fiber obtained by subjecting the sea-island composite fiber to a sea component removal treatment. Further, the disclosure relates to a fiber product formed at least partially by the sea-island composite fiber or the conjugate thin fiber.

BACKGROUND

Fibers produced using a thermoplastic polymer such as polyester or polyamide are widely used not only in clothing applications, but also in interior and vehicle interior applications, industrial applications and so on because these fibers are excellent in mechanical properties and dimensional stability. Currently, however, uses of fibers are diversified, and required characteristics thereof are accordingly diversified. Because of this, techniques that impart sensitive effects such as texture and bulkiness by the cross-section structure of fibers are proposed. In particular, "thinning of fibers" has a significant effect on the characteristics of fibers themselves and characteristics after formation of fibers into a fabric, and is a mainstream technique with regard to control of the cross-section structure of fibers.

As a method of manufacturing thin fibers, a method using so-called "sea-island" composite fiber with a sea component covering island components that form thin fibers is often employed on an industrial scale in consideration of, for example, handling characteristics in high-order processing. In that method, a plurality of island components composed of a poorly soluble component are disposed in a sea component composed of an easily soluble component, and after formation of fibers or a fiber product, the sea component is dissolved and removed to generate thin fibers composed of island components. That method is often employed as a method of manufacturing thin fibers currently produced on an industrial scale, especially microfibers and, recently, advancement of this technique has made it possible to manufacture nanofibers having a further reduced fiber diameter.

In microfibers with a single fiber diameter of several μm and nanofibers with a single fiber diameter of several hundreds nm, the surface area per weight (specific surface area) considerably increases in proportion to the square of the fiber diameter as compared to ordinary fibers (fiber diameter: several tens μm). The microfibers and nanofibers are known to exhibit a unique tactile impression created by the ductility of the fibers because the rigidity (cross-section secondary moment) of the fibers increases with the fiber diameter.

Accordingly, those fibers exhibit specific characteristics that cannot be obtained with ordinary fibers, and the fibers are being developed not only in clothing applications, but also in various applications by taking advantage of, for example, improvement of wiping performance due to an increase in contact area, gas absorbing performance associated with an ultra-specific surface area effect, and a unique soft touch.

Regarding techniques to thin fibers as described above, numerous techniques have been proposed, and among them, ultimate techniques are proposed in Japanese Patent Laid-Open Publication Nos. 2007-100243 and 2011-157646.

In JP '243, thin fibers (nanofibers) having high mechanical properties in which the toughness of (thin) fibers after dissolution of a sea component is 20 or more can be obtained by defining the fiber diameter and the average diameter and arrangement of island components in a sea-island-type composite fiber. In JP '646, the cross-section parameter of a sea-island cross-section is defined to prevent unnecessary treatment of thin fibers composed of island components at the time of dissolving and removing a sea component in a method of manufacturing thin fibers using a sea-island composite fiber. JP '243 describes that relatively high mechanical properties can be obtained, and development of the thin fibers to fiber products may be promoted.

In JP '646, it is proposed that polytrimethylene terephthalate having relatively flexible characteristics is employed in island components for improving the tactile impression and texture of a thin fiber bundle. In JP '646, thin fiber bundles and fiber products having improved softness and flexibility as compared to those in JP '243 may be obtained.

Japanese Patent Laid-Open Publication No. H05-222668 describes a sea-island composite fiber in which island components are formed such that ultra-thin fiber components of two or more types including polyamide and polyester with a size of 0.001 to 0.3 denier (equivalent to a fiber diameter of 300 nm to 6 μm) are dispersively arranged substantially without forming a group. In that technique, the sea component is removed from the sea-island composite fiber, and a heating treatment is performed so that thin fibers composed of polyester and polyamide are each uniquely shrunk. Using, for example, a shrinkage difference between the thin fibers, the alignment of the thin fibers is disordered to generate a yarn length difference in a thin fiber bundle, and in comparison with conventional thin fibers, woven/knitted fabrics having a bulky feeling in the thickness direction as well may be obtained.

In a sea-island composite fiber of conventional type as described in JP '243, thin fibers after removal of the sea component tend to form a bundle while every thin fiber is kept straight without being bent. Accordingly, the thin fibers are orderly aligned so that gaps between fibers are very small, and therefore when an external force is applied to the thin fiber bundle, the thin fibers are mostly moved in a bundle state without being opened so that exhibition of a flexible and delicate tactile impression, which is expected from reduction of the fiber diameter, may be limited. A fabric composed of such thin fiber bundles often provides a fiber product poor in water absorbency and contaminant catching performance, which require a capillary phenomenon because bulkiness in the thickness direction is hardly exhibited, and gaps between fibers are small.

As a countermeasure to this problem, the sea-island composite fiber itself may be subjected to false twist processing, or the sea-island composite fiber may be mixed with ordinary fibers composed of other type of polymer. In any case, however, the state (bulkiness or the like) of a thin fiber bundle remaining the history of an original sea-island composite fiber cross-section after removal of the sea component is not remarkably improved, development of thin fibers alone to high-performance apparels (outers, inners and the like) in which particularly the tactile impression and the texture are important and high-performance wiping cloths which are required to have wiping performance with high accuracy is difficult, and the composition design of the fabric is uselessly complicated due to, for example, mixing with ordinary fibers as described above and the configuration of a weaving and knitting composition. Thus, development of the thin fibers may be limited.

In JP '646, a fiber bundle in which thin fibers are orderly aligned is formed, and therefore the thin fiber bundle is somewhat flexible, but it is difficult to say that a flexible and delicate texture created by thin fibers is sufficiently exhibited, and in particular, the porosity between thin fibers is very small, and the problem of poor bulkiness of woven/knitted fabrics composed of the thin fibers is not solved.

In the technique in JP '668, a shrinkage difference between thin fibers generated by performing a heating treatment is used. In other words, some thin fibers exhibit a crimped structure due to shrinkage, while other thin fibers are still kept straight, and the straight thin fibers may limit the disorder of alignment in the fiber bundle.

Accordingly, that technique is not sufficient to obtain woven/knitted fabrics having bulkiness while securing flexibility specific to thin fibers, and it is strongly desired to develop a composite fiber suitable to obtain a high-performance and high-texture fiber product with a bulky feeling in the thickness direction, which is capable of maximally exhibiting flexibility specific to thin fibers and their delicate tactile impression.

It could therefore be helpful to provide a sea-island composite fiber from which a conjugate thin fiber can be manufactured with high productivity by using existing equipment, the conjugate thin fiber having various functions such as those of high-performance processing treatment and structure control in addition to mechanical properties, abrasion resistance and bulkiness while having a delicate tactile impression specific to thin fibers.

SUMMARY

We thus provide:

Our sea-island fiber has the following constitution. That is, a sea-island composite fiber in which island components are interspersed in a sea component on a fiber cross-section, wherein the island components have a composite structure formed with two or more different polymers joined together, and the ratio (L/D) of the length (L) of the joint section of the island component and the diameter (D) of the composite island component is 0.1 to 10.0.

A conjugate thin fiber has the following constitution. That is, a conjugate thin fiber obtained by subjecting the sea-island composite fiber to a sea component removal treatment.

A fiber product has the following constitution. That is, a fiber product formed at least partially by the sea-island composite fiber or the conjugate thin fiber.

In the sea-island fiber, the diameter of the island component with two or more different polymers joined together is preferably 0.2 μm to 10.0 μm.

The variation of diameter of island component is preferably 1.0 to 20.0% in the island component with two or more different polymers joined together.

The composite ratio in the island component is preferably 10/90 to 90/10 in the island component with two or more different polymers joined together.

The ratio (S/I) of the viscosity (I) of the island component polymer and the viscosity (S) of the sea component polymer is preferably 0.1 to 2.0.

The viscosity (I) of the island component polymer is the viscosity of an island component polymer having the highest viscosity in the two or more island component polymers.

The island components are joined together preferably in side-by-side form.

Preferably, the conjugate thin fiber is of side-by-side type in which a fiber cross-section in a direction vertical to the fiber axis has a structure with two polymers bonded together, and the conjugate thin fiber has a single fiber fineness of 0.001 to 0.970 dtex and a bulkiness of 14 to 79 $cm^3/g$.

Preferably, the conjugate thin fiber has a stretch extensibility of 41 to 223%.

By utilizing a sea-island composite fiber, thin composite fibers having a considerably reduced fiber diameter can be manufactured, and high-performance fibers developable to various application fields are obtained. That is, thin fibers obtained by removing a sea component from the sea-island composite fiber are conjugate thin fibers having characteristics of two or more polymers. Accordingly, conjugate thin fibers having various functions such as those of high-performance processing treatment and structure control in addition to mechanical properties, abrasion resistance and bulkiness while having a delicate tactile impression specific to thin fibers are obtained, and application development of thin fibers is considerably expanded.

Before removal of the sea component, the sea-island composite fiber has a fiber diameter comparable to that of a general fiber, and the composite island components are covered with the sea component. Accordingly, the sea-island composite fiber has better high-order processability, and therefore also has such an industrial advantage that a high-performance fiber material excellent in quality can be manufactured with high productivity by using existing equipment.

BRIEF DESCRIPTION OF THE DRAWINGS

FIG. 1 is a schematic view explaining a cross-section structure of an island component, and shows an example of a composite island component or a conjugate thin fiber, where FIG. 1(*a*) shows a sheath-core-type cross-section, FIG. 1(*b*) shows a side-by-side-type cross-section, FIG. 1(*c*) shows a separate-type cross-section, and FIG. 1(*d*) shows a sea-island-type cross-section.

FIG. 2 is a schematic view for explaining an island component in the sea-island composite type.

FIG. 3 is a schematic view of one example of a cross-section of a sea-island composite fiber, and shows an example of a sea-island composite cross-section in which an island component has a side-by-side structure.

FIG. 4 is an explanatory view for explaining a method of manufacturing a sea-island composite fiber, and shows one example of a composite spinneret, where FIG. 4(*a*) is a front sectional view of main parts that form the composite spinneret, FIG. 4(*b*) is a cross sectional view of a part of a distribution plate, and FIG. 4(*c*) is a cross sectional view of a nozzle plate.

FIG. 5 shows one example of an example of arrangement of distribution nozzles in a final distribution plate, where FIGS. 5(*a*), 5(*b*) and 5(*c*) are enlarged views showing a part of the final distribution plate.

DESCRIPTION OF REFERENCE SIGNS

1: Island component 1

2: Island component 2

3: Sea component
4: Joint section of island components
5: Diameter of island component (circumscribed circle)
6: Measuring plate
7: Distribution plate
8: Nozzle plate
9: Measuring nozzle
9-(*a*): Polymer A (island component 1)•measuring nozzle
9-(*b*): Polymer B (island component 2)•measuring nozzle
9-(*c*): Polymer C (sea component)•measuring nozzle
10: Distribution groove
11: Distribution nozzle
12: Discharge/introduction nozzle
13: Reduction nozzle
14: Discharge nozzle
15: Polymer A (island component 1)•distribution nozzle
16: Polymer B (island component 2)•distribution nozzle
17: Polymer C (sea component)•distribution nozzle

DETAILED DESCRIPTION

Hereinafter, our fibers and products will be described in detail along with preferred examples.

A sea-island composite fiber is a fiber in which island components are interspersed in a sea component on a fiber cross-section in a direction vertical to the fiber axis.

In the sea-island composite fiber, the island component is required to have a composite cross-section formed with two or more different polymers joined together. The composite island component is one in which two or more polymers having different polymer characteristics are joined together substantially without being separated from each other, and the island component may have any composite structure with two or more polymers joined together such as that of sheath-core type in which one component is covered with the other component (FIG. 1(*a*)) as seen in a general composite fiber, side-by-side type in which two or more components are bonded together (FIG. 1(*b*)), separate type in which in one component, the other component is arranged in a slit form (FIG. 1(*c*)), or sea-island type in which in one component, the other component is interspersed (FIG. 1(*d*)).

The state formed by the island component and in which two or more polymers are joined together substantially without being separated from each other means a state in which a polymer A for island component (polymer A: 1 in FIG. 2) and a polymer B for island component (polymer B: 2 in FIG. 2) are bonded together with a joint surface. Accordingly, even after the covering sea component polymer (polymer C: 3 in FIG. 2) is removed, the polymer A and the polymer B are formed one fiber without being detached from each other.

In the composite structure of the island components, the components are not required to be vertically and horizontally symmetrically arranged, and may have, for example, a modified composite structure in which island components exist in a biased manner in an eccentric sheath-core structure or a sea-island structure. Further, the composite structure may be one in which two or more composite structures are hybridized, and a selection can be made from various hybrid structures such as a sheath-core and sea-island hybrid structure in which the thickness of the sea component layer at the surface layer is increased while the structure has a sea-island cross-section, and a sheath-core and side-by-side hybrid structure in which a sheath component is further provided on a side-by-side-type cross-section.

By utilizing these diverse composite structures, characteristics of two or more polymers can be imparted to thin fibers. Accordingly, for example, when abrasion resistance is to be imparted to thin fibers, a core component and a sheath component may be made to have different molecular weights so that a difference is generated in alignment of fiber structures, or a polymer obtained by copolymerizing a third component with a sheath component may be used to form a sheath-core cross-section depending on a use purpose. The composite fiber may have a configuration in which an amorphous polymer such as polystyrene is disposed in a sheath component to add a functional agent to thin fibers, and polyester, polyamide or the like is used for a core component so that the substantial mechanical properties of the thin fibers are borne by the core component. Such a configuration is one of the preferred use forms because the specific surface areas of thin fibers can be sufficiently utilized.

When a functional agent is to be added to thin fibers as described above, it is preferred to select a separate-type or sea-island type structure that makes it possible to increase the specific surface area by a slit or the like or provide an anchor effect. Using a sheath-core-type or sea-island-type cross-section, thin hollow fibers having a lightweight property can be obtained by forming a structure with an easily soluble polymer existing in island components, and dissolving and removing the easily soluble component in thin fibers. Particularly, it is preferred to use a sea-island cross-section to obtain the thin hollow fibers because a lotus root-like structure is formed, and therefore even if a force is applied in the compression direction, the structure is hardly collapsed.

Among these composite structures, a side-by-side structure in which two or more polymers having different polymer characteristics are bonded together is preferable because the functions of thin fibers and products composed thereof can be considerably improved without complicating formation of a composite polymer stream as described later, high-order processing, and so on.

The composite fibers are tensile-deformed in a unified fashion in fiber production steps such as a spinning step and a drawing step. Accordingly, depending on the rigidity of the polymer, stress generated by tensile deformation is accumulated as internal energy in the island component and the sea component. In ordinary fibers having no sea component, and when the fibers are, for example, as-spun fibers in which a fiber structure is not sufficiently formed, deformation is relaxed after the fibers are wound so that internal energy is released. On the other hand, in our method, the fiber has a sea component, and therefore deformation is essentially confined in response to the behavior of the sea component. Accordingly, a state in which internal energy is sufficiently accumulated in the composite island component is maintained when the fiber is wound up and left standing. Thus, when the sea component is removed, internal energy accumulated in the island component is released, crimps are exhibited. In a side-by-side structure in which two different polymers are bonded together, exhibition of crimps varies between the polymers different in exhibition of the crimps, and therefore the thin fiber is bent not only in the cross-sectional direction of the fiber but also in the fiber axis direction so that a three-dimensional spiral structure which could not be formed in conventional thin fibers can be exhibited.

This means that suitable gaps are formed between thin fibers only by a sea component removal treatment, which is generally performed in sea-island composite fibers, without performing additional high-order processing such as false twist. This phenomenon is very important from the viewpoint of enhancement of the performance of thin fibers, a flexible and delicate tactile impression specific to thin fibers as has been suggested previously is considerably improved and, in addition, thin fiber bundles often converged in a bundle form have considerably improved opening property due to the spiral structure thereof so that various functions such as a specific surface area effect, a capillary phenomenon by gaps between fibers, and a function of retaining a functional agent become remarkable.

To practically make effective use of the previously unavailable features, it is preferred that the conjugate thin fiber has a certain degree of bulkiness, and the bulkiness of the conjugate thin fiber is preferably 14 to 79 $cm^3/g$.

In conventional thin fibers gaps between fibers are small and, therefore, for example, when the fibers are used in a wiping cloth, a treatment to improve the opening property of thin fiber bundles by applying physical impulses such as needle punches and water jets is required to impart a function of catching contaminants on the cloth. On the other hand, when the thin fibers have bulkiness as described above, they have a sufficient opening property, and an opening treatment required for conventional thin fibers is no longer required. When such an opening step can be omitted, cutting or detachment of thin fibers, which occurs in the opening step, can be prevented so that a high-performance wiping cloth excellent in quality can be obtained.

Gaps between fibers formed by such a three-dimensional spiral structure exhibit the effect also when the fibers are developed in filter applications as felts, sheet-shaped materials and the like. Specifically, in addition to improvement of collection efficiency of air dust due to reduction of the fiber diameter, the life can be increased by solving the problems in conventional thin fibers, i.e., reducing a pressure loss and suppressing clogging owing to the gaps between fibers, and thus the thin fibers can be used as a raw stock for high-performance filters. This bulkiness performance effect effectively contributes to development of the thin fibers in filter applications as described above.

For application to high-performance apparels, impregnability of a functional agent, a binder for adding the functional agent, or the like can be improved as compared to conventional techniques when the thin fibers are processed into a fabric such as a woven/knitted fabric. Specifically, a functional agent or the like once entrapped between fibers is caught in very small gaps formed by thin fibers, and therefore the thin fibers are excellent in durability as well. For impregnation of a rein or functional agent having a certain amount of particles as described above, the bulkiness is more preferably 20 to 79 $cm^3/g$.

The bulkiness is a bulkiness determined in the following manner: a fabric composed of a sea-island composite fiber is placed in a sea component removal bath (bath ratio: 1:100) filled with a solvent in which the sea component is soluble so that 99 wt % or more of the sea component is dissolved and removed to obtain a fabric composed of conjugate thin fibers, and the fabric is evaluated in accordance with JIS L1096 (2010). Specifically, from the measured thickness t (mm) per unit and mass $S_m$ ($g/m^2$) per unit, the bulkiness Bu ($cm^3/g$) of the fabric is determined in accordance with equation (1), and rounded off to the second decimal place, and the obtained value is defined as a bulkiness.

$$B_u = \frac{t}{S_m} \times 1000 \quad (1)$$

The side-by-side conjugate thin fiber exhibits stretchability resulting from a three-dimensional spiral structure, which has never been exhibited in conventional thin fibers, and accordingly an excellent texture is exhibited along with a flexible and delicate tactile impression specific to thin fibers.

The spiral structure produces elasticity that has not been achieved in conventional thin fibers, and in the conjugate thin fiber, the stretch extensibility is preferably 41 to 223%. When the stretch extensibility is in the above-mentioned range, the conjugate thin fiber has satisfactory stretchability, and has a satisfactory tactile impression along with a fineness as described later.

The stretch extensibility is determined in the following manner: 99 wt % or more of a sea component in a sea-island composite fiber is dissolved and removed to obtain conjugate thin fibers, conjugate thin fibers are taken and formed into a hank, the hank is left standing at a temperature of 25° C. and a humidity of 55% RH for 1 day, the hank length (initial sample length: $L_0$) under a load of $1.8\times10^{-3}$ cN/dtex is then measured, the load is then changed to $88.2\times10^{-3}$ cN/dtex, the hank length ($L_1$) after 60 seconds is measured, and the stretch extensibility E (%) is calculated in accordance with equation (2). The same operation is repeated five times for each level, and the average of the obtained values is rounded off to the first decimal place.

$$E = \frac{(L_1 - L_0)}{L_0} \times 100 \quad (2)$$

To exhibit the very comfortable texture having not been achieved previously, the single fiber fineness of side-by-side conjugate thin fibers obtained from the sea-island composite fiber is preferably 0.001 to 0.970 dtex. That is, exhibition of stretchability by the side-by-side structure depends on the fiber diameter. Accordingly, in side-by-side fibers having so-called an ordinary fiber diameter (several tens μm) as proposed in Japanese Patent Laid-open Publication No. 2001-131837 and Japanese Patent Laid-open Publication No. 2003-213526, there is a limit to adjustment of stretchability, and excessively exhibited stretchability may be felt as a fastening feeling. On the other hand, our combination of polymers and the fiber diameter thereof can be freely controlled and, further, the fiber diameter can be reduced to several μm (0.970 dtex) or less. Accordingly, moderate stretchability shown by thin fibers imparts a comfortable holding feeling and, further, the fine spiral structure thereof ensures very flexible contact with the human skin so that a comfortable tactile impression is provided. To promote this phenomenon to contact the thin fibers to the human skin, the single fiber fineness of the conjugate thin fibers is more preferably 0.001 to 0.400 dtex. When the single fiber fineness is in the above-mentioned range, a fastening feeling is eliminated due to low stretchability, but friction with the human skin is secured by a contact area of thin fibers, leading to excellent motion followability. Accordingly, the conjugate thin fibers can be used in a high-performance inner which does not give stress even when worn for a long period of time. Particularly, these characteristics can be suitably utilized in sports applications or the like. To secure a holding feeling so that it is able to follow a vigorous motion in sports applications or the like, the single fiber fineness of the conjugate thin fibers may be especially preferably 0.050 to 0.400 dtex. When the single fiber fineness is in the above-mentioned range, heat retaining property and water absorbency can be imparted by air layers between fibers depending on the composition of a fabric.

The single fiber fineness is determined in the following manner: 99% or more of a sea component in fiber bundles is removed from the sea-island composite fiber, a conjugate thin fiber bundle is taken, its weight per length is measured under an atmosphere at a temperature of 25° C. and a humidity of 55% RH, and from the obtained value, the weight corresponding to the length of 10,000 m is calculated. The single fiber fineness is calculated by dividing the weight of the conjugate thin fiber bundle by the number of filaments (equivalent to the number of islands) existing in the fiber bundle. The same operation is repeated ten times, the simple average of the obtained values is rounded off to the third decimal place, and the obtained value is defined as the single fiber fineness of the conjugate thin fiber.

A high-density woven fabric having stretchability can be formed from the conjugate thin fibers, and used as an outer of a down jacket or the like, and excellent color development with a deep color, which could not be rendered with conventional fibers, is exhibited due to a deep color effect from fine irregularities formed by the conjugate thin fibers.

As for the cross-section shape of the characteristic composite island component, cross-sections of various shapes may be employed such as perfectly circular cross-sections, flat cross-sections in which the ratio of the minor axis to the major axis (flattening ratio) is larger than 1.0, polygonal cross-sections such as triangular, tetragonal, hexagonal and octagonal cross-sections, daruma-shaped cross-sections having a recess portion in part, Y-shaped cross-sections and star-shaped cross-sections. These cross-sectional shapes make it possible to control the surface characteristics and mechanical properties of cloth.

In the island component, two or more polymers exist in a unified fashion, and in addition to exhibition of characteristics of thin fibers, fiber production property in spinning and drawing, and high-order processing passage property are secured. Accordingly, it is necessary to prevent detachment and separation at the time of winding up a composite fiber and high-order-processing the composite fiber, and for this purpose, it is necessary that the ratio (L/D) of the length (L) of the joint section of the polymer A and the polymer B (4 in FIG. 3) and the diameter (D) of the composite island component (5 in FIG. 3) be 0.1 to 10.0.

The length (L) of the joint section and the diameter (D) of the island component with two or more polymers combined together are determined in the following manner.

A multifilament composed of a sea-island composite fiber is embedded in an embedding agent such as an epoxy resin, and an image of the transverse cross-section of the multifilament is photographed under a transmission electron microscope (TEM) at a magnification that ensures that 100 or more island components can be observed. When metal staining is performed, the contrast of island components and joint sections of the island components can be clarified using a difference in stain between polymers. A value obtained by measuring the diameter of a circumscribed circle of each of 100 island components randomly extracted from each photographed image and within the same image corresponds to the diameter (D) of island component. If 100 or more island components cannot be observed in one composite fiber, total 100 or more island components including those in other fibers may be observed. The diameter of a circumscribed circle means the diameter of a perfect circle which is most largely circumscribed to a cut section at two or more points, where the cut section is a cross-section in a direction vertical to the fiber axis in a two-dimensionally photographed image. For explaining this using the island component of side-by-side structure shown in FIG. 3, the circle shown by the broken line in FIG. 3 (5 in FIG. 2) is the circumscribed circle mentioned here.

Using the image with which the diameter (D) of island component is measured, 100 or more island components are evaluated. A value obtained by measuring the two-dimensionally observed length over which the polymer A and the polymer B are bonded together corresponds to the length (L) of the joint section. This will be described in detail in one of the items in Examples: "D. Diameter of island component and variation (CV [%]) of diameter of island component."

In the sea-island composite fiber, the ratio (L/D) may be 10.0 or more, but the substantial upper limit of the ratio (L/D) is set to 10.0 to facilitate a spinneret design.

In the sea-island composite fiber, the ratio (L/D) should be 0.1 to 10.0 in the composite island component. The ratio (L/D) being 0.1 to 10.0 means that "two or more polymers are unified and joined together with a definite contact surface," and for detachment and separation, it is preferred that the joint surface exists with a certain length (L) with respect to the diameter (D) of island component. In this respect, the range of the ratio (L/D) is defined as a range which ensures that the composite island component can exist without being detached and separated even if a strong external force is applied with the composite fiber bent or abraded in a fiber production step, a high-order processing step or the like.

To suppress detachment, the value of the ratio (L/D) is preferably not less than 1.0 and not more than 10.0, more preferably not less than 1.0 and not more than 5.0 when the composite island component is of sheath-core type in which one polymer is substantially covered with the other polymer (FIG. 1(*a*)), separate type (FIG. 1(*c*)) or sea-island type (FIG. 1(*d*)). When the value of the ratio (L/D) is in the above-mentioned range, the polymers exist with a sufficient contact surface in the composite island component, and the relatively thinly formed sea section in the island component can exist without being broken and detached.

In the island component of side-by-side type (FIG. 1(*b*)), the value of the ratio (L/D) is preferably not less than 0.1 and not more than 5.0 for suppressing detachment. Particularly in the island component of side-by-side type, a spiral structure appropriate of a difference in shrinkage between polymers is exhibited in removal of the sea component or in the subsequent heat treatment, and therefore the ratio (L/D) is more preferably not less than 0.1 and not more than 1.0 in consideration of exhibition of this structure and durability of thin fibers in the spiral structure.

As described above, the sea-island composite fiber has previously been unavailable. Composite island components with two or more polymers existing with a necessary joint surface, and when the sea component is removed, previously unavailable thin fibers having characteristics of two or more polymers can be obtained. The feature of the thin fibers composed of composite island components consists in that they can be given functions necessary for application development such as those of high-performance processing treatment and structure control, in addition to mechanical properties, abrasion resistance and bulkiness while having an excellent tactile impression depending on the fiber diameter of the thin fibers. Accordingly, to secure the characteristic tactile impression, the diameter of the composite island component (diameter of island component: D) is preferably 0.2 μm to 10.0 μm.

In the sea-island composite fiber, the diameter of island component may be less than 0.2 μm, but when the diameter of island component is 0.2 μm or more, partial breakage of island components or the like can be suppressed in a fiber production step, and thread breakage in a post-processing step can be prevented. Generation of thin fibers from the sea-island composite fiber has the effect of simplifying setting of processing conditions. On the other hand, to ensure that a delicate tactile impression specific to thin fibers as intended, and various functions created by very small gaps between fibers are superior to those of ordinary fibers, the diameter of island component is preferably 10 μm or less. The diameter of the island component may be appropriately 0.2 to 10.0 μm depending on processing conditions and the purpose of use, but to make more effective the characteristics specific to thin fibers, the diameter of island component is more preferably in the range of 0.5 μm to 7.0 μm. When step passage property in high-order processing, simplicity in setting of sea component removal conditions, and handling characteristics are further taken into consideration, the diameter of island component is especially preferably 1.0 μm to 5.0 μm.

The island components each have a very small diameter of preferably 10 μm or less, and to improve the quality of thin fibers composed of the island components, the variation of diameter of island component is preferably 1.0 to 20.0%. When the variation of diameter of island component is in the above-mentioned range, coarse island components or extremely small island components do not partially exist on the composite cross-section, and all the island components are homogeneous. This means that in the fiber production step and the high-order processing step, stress is equally distributed to island components without being inclined toward some island components on the composite fiber cross-section, and the island components are all highly aligned so that a satisfactory fiber structure is formed. Macroscopically, a situation is suppressed in which on a cross-section of the composite fiber, stress is inclined to induce thread breakage or the like, and therefore it is preferable that the variation of diameter of island component is in the above-mentioned range. Particularly, at the time of performing a sea component removal treatment, the above-mentioned effect indirectly affects the treatment, and when the variation of diameter of island component is small, the fiber structure difference and the change in specific surface area are suppressed so that breakage and falling of thin fibers do not occur, and thus thin fibers excellent in quality are obtained. For this reason, the variation of diameter of island component is preferably as small as possible, and it is more preferably 1.0 to 15.0%. Particularly, in the case of thin fibers having a side-by-side structure, bulkiness and stretchability thereof significantly depend on accumulation of internal energy associated with the history of stress, and the variation of diameter of island component is especially preferably 1.0 to 10.0%. When the variation of diameter of island component is in the above-mentioned range, for example, thin fibers in which stress is inclined toward some island components so that the degree of exhibition of the spiral structure is partially varied do not exist. Accordingly, the thin fibers do not partially fuzz out, and are thus suitable for use in products in direct contact with the human skin such as inners, products which serve as an outer layer and are subject to abrasion, and so on.

The variation of diameter of island component mentioned here is determined from the values of diameters of island components measured for 100 or more island components randomly extracted in a two-dimensionally photographed cross-section of a sea-island composite fiber using a method similar to the above-mentioned method of determining the diameter of island component. In other words, the variation of diameter of island component is a value calculated from the average of diameters of island components and the standard deviation in accordance with the equation: variation of diameter of island component (diameter of island component CV [%])=(standard deviation/average of diameters of island components)×100(%). For ten images photographed in the same manner as described above, the values of variation of diameter of island component are determined, the simple number average of the results for the ten images is defined as a variation of diameter of island component, and the obtained value is rounded off to the first decimal place.

It is preferred that the sea-island composite fiber and thin fibers have a certain toughness when step passage property in high-order processing and practical use are taken into consideration, and the tensile strength and the elongation at break of the fiber may serve as an index of the toughness. The tensile strength is a value obtained by preparing a load-elongation curve of the fiber under conditions as shown in JIS L 1013 (1999), and dividing a load value at break by an initial fineness, and the elongation at break is a value obtained by dividing an elongation at break by a initial test length. The initial fineness means a value obtained by calculating a weight per 10,000 m from the simple average of a plurality of measurements of the weight per unit length of the fiber.

Preferably, the composite fiber has a tensile strength of 0.5 to 10.0 cN/dtex, and an elongation at break of 5 to 700%. In the sea-island composite fiber, the feasible upper limit value of the tensile strength is 10.0 cN/dtex, and the feasible upper limit value of the elongation at break is 700%. When the thin fibers are used in general clothing applications such as those of inners and outers, it is preferable that the tensile strength is 1.0 to 4.0 cN/dtex, and the elongation at break is 20 to 40%. In sportswear applications or the like where the use environment is severe, it is preferable that the tensile strength is 3.0 to 5.0 cN/dtex, and the elongation at break is 10 to 40%. Given that the thin fibers are used in industrial material applications, for example, in wiping cloths and polishing cloths, they will be rubbed against an object while being tensioned under a load.

Accordingly, it is preferred that the tensile strength is 1.0 cN/dtex or more and the elongation at break is 10% or more to prevent a situation in which thin fibers are cut to fall during wiping or the like. Thus, in our fibers, it is preferred to adjust their tensile strength and elongation at break by controlling conditions in production steps according to a use purpose or the like.

The sea-island composite fiber can be formed into a various fiber products by converting the sea-island composite fiber into a variety of intermediates such as fiber winding-up packages, tows, cut fibers, cottons, fiber balls, cords, piles, woven/knitted fabrics and nonwoven fabrics, and subjecting the intermediates to a sea component removal treatment or the like to generate thin fibers. The sea-island composite fiber can also be formed into fiber products by partially removing the sea component in an untreated state, or performing a island component removal treatment or the like.

One example of a method of manufacturing the sea-island composite fiber will be described in detail below.

The sea-island composite fiber can be manufactured by making a sea-island composite fiber having island components with two or more polymers formed with a joint surface. As a method of making the sea-island composite fiber, sea-island composite spinning by melt spinning is preferred to improve productivity. Of course, the sea-island composite fiber can also be obtained by performing solution spinning or the like. As a method of making the sea-island composite spun yarn, a method using a sea-island composite spinneret is preferable to satisfactorily control the fiber diameter and the cross-section shape.

It is very difficult to manufacture the sea-island composite fiber using a previously known pipe-type sea-island composite spinneret in that the cross-section shape of the island component is controlled. That is, in the composite island component, two or more different polymers are required to be in contact with each other and joined together. However, in the conventional pipe-type spinneret, pipes that form island components have a natural limit as to the closest distance therebetween due to the thickness of the pipe itself. Above all, pipes should be welded by mechanical processing, and it is therefore necessary to perform processing with a certain distance (several hundreds μm or more) provided between adjacent pipes to prevent strain of pipes during welding. Accordingly, it is very difficult to substantially join two or more polymers, and thus the sea-island composite fiber cannot be obtained in conventional spinneret techniques.

The essential reason why our fibers cannot be achieved in conventional spinneret techniques is that the polymer amount to be controlled is in the order of $10^{-5}$ g/min/hole, and it is necessary to control such an extremely small polymer amount which is lower by several digits than a polymer amount used in conventional techniques. In other words, in conventional spinneret techniques where a polymer amount of merely about $10^{-1}$ g/min/hole is controlled, it is very difficult to obtain a sea-island composite fiber having composite island components like our sea-island composite fiber. In this respect, we found that a method using a sea-island composite spinneret as illustrated in FIG. 4 is suitable.

In the composite spinneret shown in FIG. 4, roughly three members: a measuring plate 6, a distribution plate 7 and a nozzle plate 8 in this order from the top are incorporated into a spinning pack in a stacked state, and provided for spinning. FIG. 4 shows an example in which three polymers: a polymer A (island component 1), a polymer B (island component 2) and a polymer C (sea component) are used. In the sea-island composite fiber, poorly soluble components are used as the island components and an easily soluble component is used as the sea component when the composite island components including the polymer A and the polymer B are formed into thin fibers by dissolving the polymer C. If necessary, fibers may be produced using four or more polymers including polymers other than the poorly soluble components and easily soluble component. In composite spinning using four or more polymers, it is very difficult to achieve our fibers using a conventional pipe-type composite spinneret, and it is preferable to use a composite spinneret including fine channels as illustrated in FIG. 4.

In the spinneret members illustrated in FIG. 4, the measuring plate 6 measures polymer amounts for the discharge nozzles and distribution nozzles for sea and island components, and feeds the polymers, and the shapes of the sea-island composite cross-section and the cross section of the island component on the cross section of the single (sea-island composite) fiber are controlled by the distribution plate 7. Then, a composite polymer flow formed at the distribution plate 7 is compressed and discharged by the nozzle plate 8. For members stacked above the measuring plate, members with channels formed in conformity with the spinning machine and the spinning pack may be used although illustration of such members is omitted to avoid complication of the explanation of the composite spinneret. By designing the measuring plate 6 in conformity with existing channel members, the existing spinning pack and members thereof can be used as they are. Accordingly, it is not necessary to use the spinning machine exclusively for the composite spinneret.

It is practical to stack a plurality of channel plates (not illustrated) between the channel and the measuring plate or between the measuring plate 6 and the distribution plate 7. This is intended to provide channels through which the polymer is efficiently transferred in the cross-section direction of the spinneret and the cross-section direction of the single fiber, and introduced into the distribution plate 7. In accordance with a conventional melt spinning method, the composite polymer flow discharged from the nozzle plate 8 is cooled and solidified, then given an oil, and taken up by a roller at a predefined circumferential speed so that the sea-island composite fiber is obtained.

Hereinafter, the composite spinneret illustrated in FIG. 4 will be described in order along the flow of the polymer from the upstream to the downstream in the composite spinneret where a composite polymer flow is formed by passing through the measuring plate 6 and the distribution plate 7, and the composite polymer flow is discharged from the discharge nozzle of the nozzle plate 8.

The polymer A, the polymer B and the polymer C are fed from the upstream of the spinning pack into a polymer A measuring nozzle 9-(*a*), a polymer B measuring nozzle 9-(*b*) and a polymer C measuring nozzle 9-(*c*) in the measuring plate, measured by nozzle orifices provided at the lower end, and then fed into the distribution plate 8. Each polymer was measured by a pressure loss by the orifice provided in each measuring nozzle. The orifice is designed to ensure that the pressure loss is 0.1 MPa or more. On the other hand, it is preferable to design the orifice to ensure that the pressure loss is 30.0 MPa or less to inhibit a situation in which the pressure loss excessively increases to distort members. The pressure loss is determined by the inflow of the polymer for each measuring nozzle and the viscosity of the polymer. For example, when melt spinning is performed at a spinning temperature of 280 to 290° C. and a throughput rate of 0.1 to 5.0 g/min for each measuring nozzle using a polymer having a viscosity of 100 to 200 P·sat a temperature of 280° C. and a strain rate of 1,000 $s^{-1}$, the polymer can be discharged with good measurability as long as the orifice of the measuring nozzle has a nozzle diameter of 0.01 to 1.00 mm and a ratio L/D (discharge nozzle length/discharge nozzle diameter) of 0.1 to 5.0. When the melt viscosity of the polymer is below the above-described viscosity range, or the throughput rate in each nozzle decreases, the nozzle diameter may be reduced to approach the lower limit of the above-mentioned range and/or the nozzle length may be increased to approach the upper limit of the above-mentioned range. Conversely, when the viscosity is high or the throughput rate increases, the nozzle diameter and the nozzle length may be each conversely manipulated.

Preferably, a plurality of measuring plates 6 are stacked to measure the polymer amount in stages. More preferably, measuring nozzles are provided in two to ten stages. Division of the measuring plate or the measuring nozzle into a plurality of parts is suitable to control a polymer in a very small amount on the order of $10^{-5}$ g/min/hole, which is lower by several digits than a polymer amount used in conventional techniques.

Polymers discharged from the measuring nozzles 9 are individually fed into a distribution groove 10 of the distribution plate 7. The distribution plate 7 is provided with the distribution groove 10 to store polymers fed from the measuring nozzles 9, and the lower surface of the distribution groove is provided with a distribution nozzle 11 to feed polymers to the downstream. Preferably, the distribution groove 10 is provided with two or more distribution nozzles 11. Preferably, a plurality of distribution plates 9 are stacked so that the polymers are in part individually merged/distributed repeatedly. This means that when channels are designed to provide the repetition of a plurality of distribution nozzles 11—distribution groove 10—a plurality of distribution nozzles 11, the polymer flow can be fed into other distribution nozzles 11. Accordingly, even if the distribution nozzles 11 are partially clogged, a missing part is filled in the distribution groove 10 in the downstream. The same distribution groove 10 is provided with a plurality of distribution nozzles 11, and this structure is repeated so that even if a polymer in the clogged distribution nozzle 11 is fed into other nozzles, there is substantially no influence. Further, the effect of providing the distribution groove 10 is significant in the sense that viscosity variations are suppressed as polymers passing through various channels, i.e., experiencing various thermal histories are merged multiple times. Particularly, in the sea-island composite fiber, it is necessary to subject at least three polymers to composite spinning, and therefore the consideration for viscosity variations and thermal histories is effective to improve the accuracy of the composite cross-section. When channels are designed to provide the repetition of distribution nozzles 11—distribution groove 10—distribution nozzles 11, a structure in which a distribution groove in the downstream is disposed at an angle of 1 to 179° in the circumferential direction with respect to a distribution groove in the upstream to merge polymers fed from different distribution grooves is effective to control the sea-island composite cross-section because polymers experiencing different thermal histories are merged multiple times. For the above-mentioned purpose, it is preferable that the mechanism of merging and distribution is employed in sections including a more upstream section, and it is preferred that the measuring plate 6 and members upstream of the measuring plate 6 are also provided with the mechanism. In a composite spinneret having such a structure, the flow of the polymer is always stable as described above so that a high-accuracy sea-island composite fiber required can be manufactured.

The number of island components per one discharge nozzle may be theoretically 1 to an infinite number as long as there is an available space. The practically feasible total number of island components is preferably 2 to 10,000. The island filling density may be 0.1 to 20.0 island components/$mm^2$.

The island filling density mentioned here refers to the number of island components per unit area, and as this value becomes larger, the number of island components in a sea-island composite fiber that can be manufactured increases. The island filling density mentioned here is a value determined by dividing the number of island components, which are discharged from one discharge nozzle, by the area of the discharge/introduction nozzle. The island filling density can be changed for each discharge nozzle.

The cross-section structure of the composite fiber and the cross-section structure (composite structure and shape) of the island component can be controlled by the arrangement of the distribution nozzles 9 on the last distribution plate immediately above the nozzle plate 8.

To obtain the sea-island composite fiber, it is preferable that a novel composite spinneret as described above is employed, and in addition, the melt viscosity ratio (S/I) of the melt viscosity (I) of the island component polymer (polymer A or polymer B) and the melt viscosity (S) of the sea component polymer is 0.1 to 2.0. The melt viscosity mentioned here refers to a melt viscosity which can be determined by measuring a chip-shaped polymer using a capillary rheometer with the moisture content reduced to 200 ppm or less by a vacuum dryer. The melt viscosity means a melt viscosity at the same shear velocity as that at a spinning temperature. The melt viscosity I of the island component polymer means the highest melt viscosity of the melt viscosities of two or more island component polymers.

The cross-section structure of the island component is controlled essentially by the arrangement of distribution nozzles, but it is considerably reduced in size in the cross-section direction by a reduction nozzle 13 after formation of a composite polymer flow. Accordingly, the melt viscosity ratio at this time, i.e., the rigidity ratio of the molten polymer may affect formation of a cross-section. Accordingly, the ratio (S/I) is more preferably 0.1 to 1.0. Particularly in the above-mentioned range, the rigidity of the polymer is higher in the island component than in the sea component, stress is applied preferentially to the island component in tensile deformation in the fiber production step and the high-order processing step. Accordingly, the island components are highly aligned to firmly form a fiber structure, and therefore at the time when the sea component is dissolved in a solvent, a situation can be prevented in which the island components are unnecessarily treated to cause degradation. Further, the island components in which a fiber structure is sufficiently aligned also have satisfactory mechanical properties when formed into thin fibers, and in addition, in the sea-island composite fiber, mechanical properties are borne substantially by the island components. Therefore, it is preferred that the ratio (S/I) is 0.1 to 1.0 from the viewpoint of exhibition of the mechanical properties of the sea-island composite fiber and thin fibers. Further improvement of mechanical properties as described above is a notable point from the viewpoint of passage property to a high-order processing step in which a relatively high tensile strength is applied, and quality of thin films.

Particularly when island components having a side-by-side structure and thin fibers composed of the island components are manufactured, exhibition of a three-dimensional spiral structure significantly depends on accumulation of internal energy in the fiber production step and the high-order processing step as described above, and the ratio (S/I) is preferably 0.1 to 1.0 to improve the appeal point of the thin fibers. From the viewpoint of exhibition of a spiral structure, smaller the ratio (S/I), the better, and when spinnability such as discharge stability of the composite polymer flow is further taken into consideration, the ratio (S/I) is further preferably 0.3 to 0.8.

The melt viscosity of the polymers can be relatively freely controlled by adjusting the molecular weight and copolymerization components even when they are the same kinds of polymers and, therefore, the melt viscosity is used as an indicator for combination of polymers and setting of spinning conditions.

The composite polymer flow discharged from the distribution plate 7 is fed into the nozzle plate 8. It is preferable to provide the nozzle plate 8 with a discharge/introduction nozzle 12. The discharge/introduction nozzle 12 ensures that the composite polymer flow discharged from the distribution plate 7 is fed vertically to the discharge surface over a fixed distance. This is intended to relax a difference in flow rate among the polymer A, the polymer B and the polymer C and reduce the flow rate distribution of the composite polymer flow in the cross-section direction. At least three polymers form a composite polymer flow, and therefore it is preferred to provide the discharge/introduction nozzle 12 from the viewpoint of discharge stability in a cross-section structure or the like.

To suppress the flow rate distribution, it is preferable to control the flow rate of the polymer by the throughput rate of each polymer in the distribution nozzle 11, the nozzle diameter and the number of nozzles. However, when this is incorporated in the design of a spinneret, the number of island components may be limited. Accordingly, it is necessary to take the molecular weight of the polymer into consideration, but it is preferable to design the discharge/introduction nozzle 12 such that the time until the composite polymer flow is introduced into the reduction nozzle 13 is $10^{-1}$ to 10 seconds (=length of discharge/introduction nozzle/polymer flow ratio) for ensuring that the flow rate ratio is almost completely relaxed. When the above-mentioned range is satisfied, the distribution of the flow rate is sufficiently relaxed so that the stability of the cross-section is effectively improved.

Next, the composite polymer flow is reduced in size in the cross-section direction along the polymer flow by the reduction nozzle 13 during introduction of the composite polymer flow into a discharge nozzle having a desired diameter. The flow line of the middle layer of the composite polymer flow is almost straight, but is largely curved as the outer layer is approached. To obtain the sea-island composite fiber, it is preferable that the composite polymer flow is reduced in size without collapsing the cross-section structure of the composite polymer flow composed of an infinite number of polymer flows including the polymer A, the polymer B and the polymer C. Accordingly, it is preferred that the angle of the nozzle wall of the reduction nozzle 13 is 30° to 90° with respect to the discharge surface.

To maintain the cross-section structure in the reduction nozzle 13, it is preferable that a distribution plate immediately above the nozzle plate is provided with a large number of distribution nozzles for sea component, and a layer of the sea component is provided on the outermost layer of the composite polymer flow. The reason for this is as follows. The composite polymer flow discharged from the distribution plate is considerably reduced in size in the cross-section direction by the reduction nozzle. At this time, the flow is largely curved in the outer layer part of the composite polymer flow, and in addition, the composite polymer flow is subject to shearing with the nozzle wall. Detailed observation of the nozzle wall-polymer flow outer layer shows that a flow rate distribution may be inclined by shear stress such that at the contact surface with the nozzle wall, the flow rate is low, but increases as the inner layer is approached. That is, the shear stress with the nozzle wall can be borne by a layer composed of the sea component (polymer C), which is disposed at the outermost layer of the composite polymer flow so that the composite polymer flow, especially the flow of island components can be stabilized. Accordingly, in the sea-island composite fiber, the stability of the fiber diameter and the cross-section shape of the composite island component is considerably improved.

In this way, the composite polymer flow passes through the discharge/introduction nozzle 12 and the reduction nozzle 13, and is discharged from the discharge nozzle 14 to a spinning line while maintaining a cross-section structure consistent with the arrangement of distribution nozzles 11. The discharge nozzle 14 is intended to control the flow rate of the composite polymer flow, i.e., a draft (=take-up velocity/discharge speed) on the point where the throughput rate is measured again, and the spinning line. It is preferred that the nozzle diameter and the nozzle length of the discharge nozzle 14 are determined in consideration of the viscosity and the throughput rate of the polymer. In manufacturing of the sea-island composite fiber, it is preferred to select the discharge nozzle diameter D of 0.1 to 2.0 mm and the ratio (L/D) (discharge nozzle length/discharge nozzle diameter) of 0.1 to 5.0.

The sea-island composite fiber can be manufactured using a composite spinneret as described above, and in view of productivity and simplicity of equipment, it is preferred to manufacture the sea-island composite fiber by melt spinning. It is needless to say that the sea-island composite fiber can be manufactured also by a spinning method using a solvent as in solution spinning, as long as the composite spinneret is used.

When melt spinning is selected, examples of the polymers of the island component and the sea component include polymers capable of being melt-molded such as polyethylene terephthalate, polyethylene naphthalate, polybutylene terephthalate, polytrimethylene terephthalate, polypropylene, polyolefins, polycarbonate, polyacrylate, polyamide, polylactic acid, thermoplastic polyurethane and polyphenylene sulfide, and copolymers thereof. Particularly, the melting point of the polymer is preferably 165° C. or higher because satisfactory heat resistance is obtained. The polymer may contain various kinds of additives such as an inorganic substance such as titanium oxide, silica or barium oxide, a colorant such as carbon black, a dye or a pigment, a flame retardant, a fluorescent brightening agent, an antioxidant, and an ultraviolet absorber.

For combination of the island component (poorly soluble component) and the sea component (easily soluble component), it is preferred that a poorly soluble component is selected in accordance with an intended application, and an easily soluble component capable of being spun at the spinning temperature is selected based on the melting point of the poorly soluble component. It is preferable to adjust the molecular weight or the like of each component in consideration of the above-mentioned ratio (S/I) (melt viscosity ratio) to improve the homogeneity of the fiber diameters and cross-section shapes of island components in the sea-island composite fiber. When conjugate thin fibers are manufactured using the sea-island composite fiber, it is preferable that the difference between the rates of dissolution of the poorly soluble component (island component) and the easily soluble component (sea component) in a solvent to be used for removal of the sea component is as large as possible, and it is practical to select a combination of polymers from the above-mentioned polymers such that the rate of dissolution of easily soluble component is larger by up to 3,000 than that of the poorly soluble component.

It is preferred to select the sea component polymer from polymers capable of being melt-molded and are more easily soluble than other components such as polyester and copolymers thereof, polylactic acid, polyamide, polystyrene and copolymers thereof, polyethylene and polyvinyl alcohol. The sea component is preferably copolymerization polyester, polylactic acid, polyvinyl alcohol or the like which is easily soluble in an aqueous solvent or hot water, and particularly, from the viewpoint of spinnability and ease of dissolution in a low-concentration aqueous solvent, it is preferable to use polyester or polylactic acid in which polyethylene glycol and sodium sulfoisophthalic acid are copolymerized alone or in combination. From the viewpoint of sea component removal property and opening property of thin fibers after removal of the sea component, polylactic acid, polyester in which 3 mol % to 20 mol % of 5-sodium sulfoisophthalic acid is copolymerized, and polyester in which 5 wt % to 15 wt % of polyethylene glycol having a molecular weight of 500 to 3,000 is copolymerized in addition to the 5-sodium sulfoisophthalic acid are especially preferable. Particularly, polyester in which the 5-sodium sulfoisophthalic acid is copolymerized alone and polyester in which polyethylene glycol is copolymerized in addition to the 5-sodium sulfoisophthalic acid are preferred from the viewpoint of fiber production property, handling characteristics and fiber characteristics because a highly aligned fiber structure can be formed without hindering deformation of island components in the fiber production step while crystallinity is maintained.

As a combination of island component polymers suitable for manufacturing side-by-side conjugate thin fibers from the sea-island composite fiber, a combination of polymers which generates a shrinkage difference at the time of performing a heating treatment is preferable. In this respect, a combination of polymers having different molecular weights or compositions to the extent that a viscosity difference of 10 Pa·s more is generated in terms of a melt viscosity is preferable.

As a specific combination of polymers, it is preferable to use any of polyethylene terephthalate, polyethylene naphthalate, polybutylene terephthalate, polytrimethylene terephthalate, polyamide, polylactic acid, thermoplastic polyurethane and polyphenylene sulfide as the polymer A and the polymer B with the molecular weight changed therebetween, or use a homopolymer as one polymer and a copolymer as the other polymer for suppressing detachment. To improve bulkiness by a spiral structure, a combination with different polymer compositions is preferable. For example, a combination of polyethylene terephthalate/polybutylene terephthalate, polyethylene terephthalate/polytrimethylene terephthalate, polyethylene terephthalate/thermoplastic polyurethane or polybutylene terephthalate/polytrimethylene terephthalate is preferable as a combination of polymer A/polymer B.

It is preferred that the spinning temperature is a temperature at which principally a polymer having a high melting point and a high viscosity among the polymers determined to be used from the above-mentioned viewpoint exhibits fluidity. The temperature at which the fluidity is exhibited varies depending on the characteristics and molecular weight of the polymer, but this temperature is based on the melting point of the polymer, and may be set to a temperature equal to or lower than the melting point+60° C. When the temperature at which the fluidity is exhibited is equal to or lower than the above-mentioned temperature, a reduction in molecular weight is suppressed without causing thermal decomposition or the like of the polymer in the spinning head or spinning pack so that the sea-island composite fiber can be satisfactorily manufactured.

The throughput rate of the polymer may be 0.1 g/min/hole to 20.0 g/min/hole for each discharge nozzle as a range which ensures that the polymer may be melt-discharged while stability is maintained. It is preferable to consider a pressure loss in the discharge nozzle with which stability of discharge can be secured. Preferably, the pressure loss is 0.1 MPa to 40 MPa, and based on this range, the throughput rate is determined in view of the relationship with the melt viscosity of the polymer, the discharge nozzle diameter and the discharge nozzle length.

The ratio of the island components (polymer A+polymer B) and the sea component (polymer C) at the time of spinning the sea-island composite fiber can be selected within the sea/island ratio of 5/95 to 95/5 in terms of a weight ratio based on the throughput rate. It is preferred to increase the island ratio in the sea/island ratio from the viewpoint of productivity of thin fibers. The sea/island ratio is more preferably 10/90 to 50/50 as a range which ensures that long-term stability of the sea-island composite cross-section can be secured and thin fibers can be efficiently manufactured in a well-balanced manner while stability is maintained. Further to quickly complete the sea component removal treatment and improve the opening property of thin fibers, the sea/island ratio is especially preferably 10/90 to 30/70.

The sea-island composite fiber is characterized in that the island components thereof have a composite structure, and it is preferable that the ratio of the polymer A and the polymer B (polymer A/polymer B) in the island component is selected within the range of 10/90 to 90/10 in terms of a weight ratio based on the throughput rate. The ratio in the island component is selected according to intended characteristics and characteristics to be imparted to thin fibers, and when the ratio is in the above-mentioned range, conjugate thin fibers having characteristics of two or more polymers as intended can be manufactured.

Fiber threads melt-discharged from the discharge nozzles are cooled and solidified, given an oil, thereby converged, and taken up by a roller having a predefined circumferential speed. The take-up velocity is determined from a throughput rate and an intended fiber diameter. The take-up velocity may be preferably 100 m/min to 7,000 m/min to stably manufacture the sea-island composite fiber. Preferably, the spun sea-island composite fiber is stretched to improve heat stability and mechanical properties. Drawing may be performed after the spun sea-island composite fiber is once wound up, or drawing may be performed subsequently to spinning without once winding up the sea-island composite fiber.

As the drawing conditions, for example, a fiber that can be generally melt-spun and is composed of a thermoplastic polymer is reasonably extended in the fiber axis direction by a circumferential speed ratio between a first roller set at a temperature equal to or higher than the glass transition temperature and equal to or lower than the melting point and a second roller set at a temperature equivalent to the crystallization temperature, and is heat-set and wound up in a drawing machine including one or more pairs of rollers. When the fiber is composed of a polymer which does not show glass transition, the dynamic viscoelasticity (tan 6) of the sea-island composite fiber is measured, and a temperature equal to or higher than the peak temperature on the high-temperature side of the obtained tan 6 is selected as a pre-heating temperature. It is also preferred to carry out the drawing step in multiple stages for increasing the draw ratio to improve mechanical properties.

To generate conjugate thin fibers from the sea-island composite fiber, an easily soluble component may be removed by immersing the composite fiber in a solvent in which the easily soluble component can be dissolved. When the easily soluble component is copolymerization polyethylene terephthalate in which 5-sodium sulfoisophthalic acid, ethylene glycol and so on are copolymerized, polylactic acid or the like, an aqueous alkali solution such as an aqueous sodium hydroxide solution can be used. As a method of treating the composite fiber with an aqueous alkali solution, for example, the composite fiber or a fiber structure composed thereof may be immersed in the aqueous alkali solution. It is preferable that the aqueous alkali solution is heated to 50° C. or higher because hydrolysis can be caused to quickly proceed. It is preferable to use a dyeing machine or the like from an industrial point of view because a large amount of the composite fiber can be treated at a time, leading to improvement of productivity.

The method of manufacturing thin fibers has been described above based on a general melt-spinning method, but it is needless to say that the thin fibers can also be manufactured by a melt-blow method or a spunbond method, and further the thin fibers can be manufactured by solution spinning methods of wet type, dry-wet type and so on.

EXAMPLES

Hereinafter, thin fibers will be described in detail by way of Examples.

In Examples and Comparative Examples, the following evaluations were performed.

A. Melt viscosity of polymer

The melt viscosity was determined by measuring a chip-shaped polymer while changing the strain rate in stages in CAPILOGRAPH 1B manufactured by TOYO SEIKI SEISAKU-SHO, LTD. with the moisture content reduced to 200 ppm by a vacuum dryer. The measurement temperature was same as a spinning temperature. A melt viscosity at 1216 $s^{-1}$ is described in Examples and Comparative Examples. The time until the start of measurement after introduction of a sample into a heating furnace was set to 5 minutes, and a measurement was made under a nitrogen atmosphere.

B. Fineness (Sea-Island Composite Fiber and Conjugate Thin Fiber)

A sea-island composite fiber is taken, its weight per length is measured under an atmosphere at a temperature of 25° C. and a humidity of 55% RH, and from the obtained value, the weight corresponding to the length of 10,000 m is calculated. This operation was repeated ten times, the simple average of the obtained values was rounded off to the nearest integer, and the obtained value was defined as a fineness.

When the single fiber fineness of a conjugate thin fiber is evaluated, 99% or more of a sea component in fiber bundles is removed from the sea-island composite fiber, a conjugate thin fiber bundle is taken, its weight per length is measured under the same atmosphere as that for sea-island composite fiber, and the weight corresponding to the length of 10,000 m is calculated. The single fiber fineness was calculated by dividing the weight of the conjugate thin fiber bundle by the number of filaments (equivalent to the number of islands) existing in the fiber bundle. The same operation was repeated ten times, the simple average of the obtained values was rounded off to the third decimal place, and the obtained value was defined as the single fiber fineness of the conjugate thin fiber.

C. Mechanical Properties of Fiber

A sea-island composite fiber and a thin fiber are measured under the condition of a sample length of 20 cm and a tensile speed of 100%/min using a tension tester "Tensilon" (registered trademark) UCT-100 manufactured by ORIENTEC Co., Ltd., to prepare a stressstrain curve. A load at break was read, the load was divided by an initial fineness to calculate a tensile strength, a strain at break was read, and divided by a sample length, and the obtained value was multiplied by 100 to calculate an elongation at break. Each of these values was determined in the following manner: the above-described operation was repeated five times for each level, a simple average of the obtained results was determined, and rounded up to the first decimal place for the tensile strength, and to the nearest integer for the elongation at break.

D. Diameter of Island Component and Variation of Diameter of Island Component (CV [%])

A sea-island composite fiber was embedded in an epoxy resin, frozen in Cryosectioning System Model FC•LIE manufactured by Reichert Company, and cut by Reichert-Nissei ultracut N (ultramicrotome) including a diamond knife, and the cut surface thereof was photographed with transmission electron microscope (TEM)H-7100 FA manufactured by Hitachi, Ltd. at a magnification allowing total 100 or more island components to be observed. Randomly selected 100 island components were extracted from this image, the diameters of all the island components were measured using image processing software (WINROOF), and the average and the standard deviation were determined. From the results thereof, a fiber diameter CV [%] was calculated in accordance with equation (3).

$$\text{Variation of diameter of island component}(CV[\%]) = (\text{standard deviation}/\text{average}) \times 100 \quad (3)$$

All the values were determined by making a measurement for the photographs of ten spots, and the average of the diameters of island components and the average of the variations of the diameters of island components at the ten spots were defined as a diameter of island component and a variation of diameter of island component, respectively. The diameter of island component is in the unit of μm, and is rounded off to the first decimal place, and the variation of diameter of island component is rounded off to the first decimal place.

E. Bulkiness

A fabric composed of a sea-island composite fiber taken under each spinning condition was placed in a sea component removal bath (bath ratio: 1:100) filled with a solvent in which the sea component was soluble so that 99 wt % or more of the sea component was dissolved and removed to obtain a fabric composed of conjugate thin fibers. This fabric was evaluated for bulkiness in accordance with JIS L 1096 (2010).

Specifically, two test pieces of about 200 mm×200 mm are taken, and each left standing at a temperature of 25° C. and a humidity of 55% RH for 1 day, and the mass of each of the test pieces is measured. From the mass, the mass per unit area ($g/m^2$) is determined, and the average thereof for the two test pieces is calculated, and rounded off to the first decimal place. The thickness of the fabric, the mass of which is determined, is measured at different five spots under a fixed pressure using a thickness measuring device, and the average for the five spots is calculated in the unit of mm, and rounded off to the second decimal place. The fixed pressure was 23.5 kPa when the fabric was a woven fabric, and 0.7 kPa when the fabric was a knitted fabric.

The bulkiness $B_u$ ($cm^3/g$) of the fabric was determined from the measured thickness per unit t (mm) and the mass per unit $S_m$ ($g/m^2$) in accordance with equation (4), and rounded off to the second decimal place.

$$B_u = \frac{t}{S_m} \times 1000 \quad (4)$$

F. Stretchability (Stretch Extensibility)

A knitted fabric composed of a sea-island composite fiber prepared under each spinning condition was placed in a sea component removal bath (bath ratio: 1:100) filled with a solvent in which the sea component was soluble so that 99 wt % or more of the sea component was dissolved and removed, and the knitted fabric was deknitted to obtain conjugate thin fibers. Conjugate thin fibers were taken and formed into a hank (1 m×10 rounds), the hank was left standing at a temperature of 25° C. and a humidity of 55% RH for 1 day, and the hank length (initial sample length: $L_0$) under a load of $1.8\times10^{-3}$ cN/dtex was then measured. The load was then changed to $88.2\times10^{-3}$ cN/dtex, the hank length ($L_1$) after 60 seconds was measured, and the stretch extensibility E (%) was determined in accordance with equation (5). The same operation was repeated five times for each level, and the average of the obtained values was rounded off to the first decimal place.

$$E = \frac{(L_1 - L_0)}{L_0} \times 100 \tag{5}$$

Example 1

Polyethylene terephthalate (PET 1, melt viscosity: 140 Pa·s) was used as an island component 1, polytrimethylene terephthalate (3GT, melt viscosity: 130 Pa·s) was used as an island component 2, and polyethylene terephthalate in which 8.0 mol % of 5-sodium sulfoisophthalic acid and 10 wt % of polyethylene glycol having a molecular weight of 1,000 were copolymerized (copolymerization PET 1, melt viscosity: 45 Pa·s) was used as a sea component. The components were individually melted at 280° C., weighed, and fed into a spinning pack including a composite spinneret as shown in FIG. 4, and a composite polymer flow was discharged from discharge nozzles. In a distribution plate immediately above a nozzle plate, distribution nozzles for island component 1 (15 in FIG. 5), distribution nozzles for island component 2 (16 in FIG. 5) and distribution nozzles for sea component (17 in FIG. 5) were arranged in a pattern as shown in FIG. 5(*a*), and 250 island components having a side-by-side composite structure were formed in one sea-island composite fiber. As the nozzle plate, one having a discharge/introduction nozzle length of 5 mm, a reduction nozzle angle of 60°, a discharge nozzle diameter of 0.5 mm and a discharge nozzle length/discharge nozzle diameter ratio of 1.5 was used.

The composite ratio of island component 1/island component 2/sea component was adjusted such that the composite ratio would be 35/35/30 in terms of a weight ratio (total throughput rate: 30 g/min). The melt-discharged fiber thread was cooled and solidified, then given an oil, and wound up at a spinning speed of 1,500 m/min to obtain an as-spun fiber. Further, the as-spun fiber was drawn (drawing speed: 800 m/min) 3.2 times between rollers heated to 80° C. and 130° C., thereby obtaining a sea-island composite fiber (104 dtex-15 filaments).

The sea-island composite fiber had a sea-island composite cross-section with island components regularly arranged as shown in FIG. 2, and the island component had a side-by-side composite cross-section with the island component 1 and the island component 2 bonded together as shown in FIG. 1(*b*). The side-by-side island component had a perfectly circular shape, existed with a sufficient joint surface with the diameter (D) of island component being 1.3 the length (L) of the joint section being 0.4 μm and the L/D ratio being 0.3, and had a very small variation with the variation of diameter of island component being 5.1%.

The sea-island composite fiber obtained in Example 1 had mechanical properties sufficient to perform high-order processing with the tensile strength being 3.9 cN/dtex and the elongation at break being 38%, and thread breakage or the like did not occur at all when the sea-island composite fiber was processed into a woven fabric and a knitted fabric.

A test piece of a knitted fabric formed from the sea-island composite fiber of Example 1 was immersed in a 1 wt % aqueous sodium hydroxide solution heated to 90° C. to remove 99 wt % or more of the sea component. In the sea-island composite fiber of Example 1, island components were equally arranged as described above, and the variation of diameter of island component was very small so that partially degraded island components did not exist, and thus a sea component removal treatment was efficiently performed. Falling of thin fibers during the removal of the sea component was examined, and the result showed that falling of thin fibers did not occur during the removal of the sea component, and the test piece had no fuzzes or the like, and was excellent in quality. A side surface and a cross-section of the test piece were observed with Laser Microscope VK-X200 manufactured by KEYENCE CORPORATION.

Resultantly, it was able to observe side-by-side thin fibers having a three-dimensional spiral structure, and it was confirmed that excellent bulkiness was exhibited with one thin fiber bundle having a cross-section having a height of 245 μm and a width of 770 μm.

The test piece had a bulky feeling while having a delicate tactile impression specific to thin fibers, and the tactile impression gave excellent comfortability with stretchability. Bulkiness and stretchability were examined using the test piece, and the result showed that the test piece had excellent characteristics as shown in Table 1. Those excellent characteristics can never be achieved with thin fibers composed of a single polymer as shown in Comparative Examples. The results are shown in Table 1.

TABLE 1

| | | | Example 1 | Example 2 | Example 3 | Example 4 | Example 5 | Example 6 |
|---|---|---|---|---|---|---|---|---|
| Polymer | Island 1 | — | PET1 | PET1 | PET1 | PET3 | PA1 | PPS1 |
| | Island 2 | — | 3GT | PBT | High shrinkage PET | PET2 | PA2 | PPS2 |
| | Sea | — | Copolymer PET1 | Copolymer PET1 | Copolymer PET1 | Copolymer PET1 | Copolymer PET1 | Copolymer PET2 |
| | S/I | — | 0.3 | 0.3 | 0.3 | 0.2 | 0.3 | 0.5 |
| Sea-island ratio | Island 1 | % | 35 | 35 | 35 | 35 | 35 | 35 |
| | Island 2 | % | 35 | 35 | 35 | 35 | 35 | 35 |
| | Island 1/Island 2 | — | 50/50 | 50/50 | 50/50 | 50/50 | 50/50 | 50/50 |
| | Sea | % | 30 | 30 | 30 | 30 | 30 | 30 |

TABLE 1-continued

| | | | Example 1 | Example 2 | Example 3 | Example 4 | Example 5 | Example 6 |
|---|---|---|---|---|---|---|---|---|
| Sea-island composite fiber | Island component composite configuration | — | Bimetal | Bimetal | Bimetal | Bimetal | Bimetal | Bimetal |
| | Island component diameter (D) | μm | 1.3 | 1.3 | 1.3 | 1.3 | 1.5 | 1.4 |
| | Island component diameter variation | % | 5.1 | 4.5 | 4.7 | 3.5 | 5.2 | 7.3 |
| | Conjugated part lengh (L) | μm | 0.4 | 0.4 | 0.4 | 0.4 | 0.4 | 0.4 |
| | L/D | — | 0.3 | 0.3 | 0.3 | 0.3 | 0.3 | 0.3 |
| | Fiber fineness | dtex | 104 | 104 | 104 | 104 | 104 | 104 |
| | Strength | cN/dtex | 3.9 | 3.6 | 3.5 | 4.0 | 4.1 | 3.2 |
| | Elongation | % | 38 | 35 | 33 | 39 | 44 | 34 |
| Ultrafine fiber | Fiber fineness | dtex | 73 | 73 | 73 | 73 | 73 | 73 |
| | Single filament fineness | dtex | 0.02 | 0.02 | 0.02 | 0.02 | 0.02 | 0.02 |
| | Strength | cN/dtex | 3.8 | 3.5 | 3.4 | 3.9 | 4.0 | 3.1 |
| | Elongation | % | 43 | 39 | 37 | 44 | 49 | 38 |
| | Bulkiness | $cm^3/g$ | 38 | 32 | 25 | 18 | 20 | 14 |
| | Stretching property (Stretching extension rate) | % | 107 | 89 | 71 | 51 | 56 | 41 |
| Remarks | | | | | | | | |

Example 2

Except that the island component 2 was changed to polybutylene terephthalate (PBT, melt viscosity: 160 Pa·s), the same procedure as in Example 1 was carried out to obtain a sea-island composite fiber.

The sea-island composite fiber of Example 2 had island components of side-by-side structure with PET 1 and PBT bonded together, and the homogeneity of the island components was as high as that in Example 1.

A test piece was prepared by forming the sea-island composite fiber of Example 2 into a knitted fabric, and the sea component was removed under the same conditions as in Example 1. Falling of thin fibers during the removal of the sea component was examined, and the result showed that as in the case of Example 1, falling of thin fibers did not occur during the removal of the sea component, and the test piece was excellent in quality.

As a result of observing the test piece, it was able to observe side-by-side thin fibers having a three-dimensional spiral structure as in the case of Example 1, and it was confirmed that excellent bulkiness was exhibited with one thin fiber bundle having a cross-section having a height of 225 μm and a width of 700 μm. The results are also shown in Table 1.

Example 3

Except that PET 1 (melt viscosity: 120 Pa·s) used in Example 1 was used as the island component 1, polyethylene terephthalate in which 7.0 mol % of isophthalic acid and 4 mol % of 2,2-bis{4-(2-hydroxyethoxy)phenyl}propane were copolymerized (PET 2, melt viscosity: 110 Pa·s) was used as the island component 2, copolymerization PET 1 (melt viscosity: 35 Pa·s) used in Example 1 was used as the sea component, the spinning temperature was 290° C., and drawing was performed between rollers heated to 90° C. and 130° C., the same procedure as in Example 1 was carried out to obtain a sea-island composite fiber.

In the sea-island composite fiber, island components having a side-by-side structure with PET 1 and PET 2 bonded together were formed, and thin fibers after removal of the sea component were slightly inferior in bulkiness and stretchability to those in Example 1 and Example 2, but had considerably improved characteristics as compared to thin fibers shown in Comparative Examples 1 to 4, and did not have problems in particular. The test piece was observed in the same manner as in Example 1, and the result showed that one thin fiber bundle in Example 3 had a cross-section having a height of 200 μm and a width of 625 μm and had a spiral structure having a larger radius of curvature as compared to Example 1. The test piece was extended by 5% with respect to the sample length at room temperature, and then subjected to a dry/heat treatment for 10 minutes in a free state (under no load) in an oven heated to 180° C. Resultantly, the test piece exhibited potential shrinkability so that the radius of curvature was reduced to improve bulkiness, and it was found that the structure was almost the same as that in Example 1 (the thin fiber bundle after the heat treatment had a height of 215 μm and a width of 680 μm). The results are also shown in Table 1.

Example 4

Except that high-molecular-weight polyethylene terephthalate (PET 3, melt viscosity: 160 Pa·s) was used as the island component 1, low-molecular-weight polyethylene terephthalate (PET 4, melt viscosity: 70 Pa·s) was used as the island component 2, copolymerization PET 1 (melt viscosity: 35 Pa·s) used in Example 1 was used as the sea component, the spinning temperature was 290° C., and drawing was performed between rollers heated to 90° C. and 130° C., the same procedure as in Example 1 was carried out to obtain a sea-island composite fiber.

As a result of using high-molecular-weight PET 3 as the island component 1, the sea-island composite fiber and thin fibers improved mechanical properties as compared to Example 1. On the other hand, the radius of curvature of the spiral structure increased as in the case of Example 3, and therefore bulkiness and stretchability were slightly lower as compared to Example 1, but sufficient bulkiness was exhibited with one thin fiber bundle having a cross-section having a height of 170 μm and a width of 530 μm. The results are also shown in Table 1.

Example 5

Except that high-molecular-weight nylon 6 (PA 1, melt viscosity: 170 Pa·s) was used as the island component 1, low-molecular-weight nylon 6 (PA 2, melt viscosity: 120 Pa·s) was used as the island component 2, copolymerization PET 1 (melt viscosity: 55 Pa·s) used in Example 1 was used as the sea component, and the spinning temperature was 270° C., the same procedure as in Example 1 was carried out to obtain a sea-island composite fiber.

Thin fibers obtained by removing the sea component from the sea-island composite fiber had a spiral structure having a large radius of curvature as in the case of Example 4 because PA 1 and PA 2 having different viscosities formed a side-by-side structure. It was confirmed that sufficient bulkiness was exhibited with one thin fiber bundle having a cross-section having a height of 180 μm and a width of 550 μm. On the other hand, comparison with Example 4 showed that since the polymer forming thin fibers was nylon 6, the test piece (knitted fabric) exhibited moderate stretchability while having a very flexible tactile impression, and thus the test piece had an excellent tactile impression. The results are also shown in Table 1.

Example 6

Except that high-molecular-weight polyphenylene sulfide (PPS 1, melt viscosity: 240 Pa·s) was used as the island component 1, low-molecular-weight polyphenylene sulfide (PPS 2, melt viscosity: 170 Pa·s) was used as the island component 2, polyethylene terephthalate in which 5.0 mol % of 5-sodium sulfoisophthalic acid was copolymerized (copolymerization PET 2, melt viscosity: 110 Pa·s) was used as the sea component, the spinning temperature was 300° C., and drawing was performed between rollers heated to 90° C. and 130° C., the same procedure as in Example 1 was carried out to obtain a sea-island composite fiber.

Thin fibers obtained by removing the sea component from the sea-island composite fiber had a three-dimensional spiral structure because PPS 1 and PPS 2 having different viscosities formed a side-by-side structure. Accordingly, it was confirmed that sufficient bulkiness was exhibited with one thin fiber bundle having a cross-section having a height of 150 μm and a width of 480 μm, and thin fibers existed in a loosened state (opening property: good). Polyphenylene sulfide is hydrophobic, and when thin fibers are formed using polyphenylene sulfide, thin fiber bundles are generally aggregated so that opening property is often deteriorated. On the other hand, it was found that as described above, the thin fiber bundle in Example 6 had excellent opening property even when a dispersion treatment or the like was not performed. The results are also shown in Table 1.

Comparative Example 1

To verify the effect of the side-by-side structure, except that the same spinneret as that in Example 1 was used, and PET 1 used in Example 1 was used as the island component 1 and the island component 2 to form conventional island components composed of a single component, the spinning temperature was 290° C., and drawing was performed between rollers heated to 90° C. and 130° C., the same procedure as in Example 1 was carried out to obtain a sea-island composite fiber.

On a cross-section of the sea-island composite fiber, island components of PET 1 alone were formed, and a regular sea-island composite cross-section was formed. In the island components, the diameter (D) of island component was 1.3 μm as in Example 1, the island component was composed of the same polymer, a joint section did not exist, and the L/D ratio was 0.

When the sea component was removed from a test piece of a knitted fabric formed from the sea-island composite fiber, the sea component removal treatment efficiently proceeded due to the regular arrangement of the island components, falling of thin fibers did not occur, and thus there was no problem in quality, but the test piece was inferior in delicate tactile impression to the test piece of Example 1.

A side surface and a cross-section of the test piece were observed with a laser microscope in the same manner as in Example 1, and the result showed that the test piece did not have a spiral structure as observed in Example 1, and had thin fibers orderly aligned in a bundle form. In Comparative Example 1, each thin fiber bundle had a cross-section having a height of 110 μm and width of 400 μm, and thus bulkiness was considerably lower as compared to Example 1, and of course, the test piece was inferior in bulkiness to the test piece of Example 1, and had no stretchability. The results are shown in Table 2.

TABLE 2

| | | | Comparative Example 1 | Comparative Example 2 | Comparative Example 3 | Comparative Example 4 |
|---|---|---|---|---|---|---|
| Polymer | Island 1 | — | PET1 | 3GT | PBT | PET1 |
| | Island 2 | — | PET1 | 3GT | PBT | PET1 |
| | Sea | — | Copolymer PET1 | Copolymer PET1 | Copolymer PET1 | Copolymer PET1 |
| | S/I | — | 0.3 | 0.3 | 0.3 | 0.3 |
| Sea-island ratio | Island 1 | % | 35 | 35 | 35 | 35 |
| | Island 2 | % | 35 | 35 | 35 | 35 |
| | Island 1/Island 2 | — | 50/50 | 50/50 | 50/50 | 50/50 |
| | Sea | % | 30 | 30 | 30 | 30 |
| Sea-island composite fiber | Island component composite configuration | — | Single component | Single component | Single component | Single component |
| | Island component diameter (D) | μm | 1.3 | 1.3 | 1.3 | 1.3 |
| | Island component diameter variation | % | 4.7 | 5.5 | 4.5 | 16.0 |
| | Fiber fineness | dtex | 104 | 104 | 104 | 104 |
| | Strength | cN/dtex | 4.1 | 3.5 | 3.1 | 3.7 |
| | Elongation | % | 41 | 37 | 33 | 34 |
| Ultrafine fiber | Fiber fineness | dtex | 73 | 73 | 73 | 73 |
| | Single filament fineness | dtex | 0.02 | 0.02 | 0.02 | 0.02 |
| | Strength | cN/dtex | 4.0 | 3.4 | 3.0 | 2.5 |
| | Elongation | % | 46 | 41 | 37 | 23 |
| | Bulkiness | $cm^3/g$ | 9 | 9 | 8 | 8 |
| | Stretching property (Stretching extension rate) | % | 10 | 11 | 9 | 9 |
| Remarks | | | | | | |

Comparative Examples 2 and 3

To verify the effect as in the purpose of Comparative Example 1, except that 3GT used in Example 1 was used as the island component 1 and the island component 2 (Comparative Example 2), or PBT used in Example 2 was used as the island component 1 and the island component 2 (Comparative Example 3), the same procedure as in Example 1 was carried out to obtain a sea-island composite fiber.

On a cross-section of the sea-island composite fiber, island components of 3GT alone (Comparative Example 2) or PBT alone (Comparative Example 3) were formed, and a regular sea-island composite cross-section was formed. In these island component, the diameter (D) of island component was 1.3 μm as in the case of Example 1, the island component was composed of the same polymer, a joint section did not exist, and the L/D ratio was 0.

In test pieces (knitted fabrics) obtained by removing the sea component from the sea-island composite fibers of Comparative Example 2 and Comparative Example 3, the tactile impression slightly varied depending on polymer characteristics, but bulkiness and stretchability were much lower as compared to the Examples. The results are also shown in Table 2.

Comparative Example 4

A pipe-type sea-island composite spinneret (the number of island components per discharge nozzle: 250) as described in Japanese Patent Laid-open Publication No. 2001-192924 was used, and PET 1 used in Example 1 was used as the polymer. A sea-island composite fiber was obtained by following Comparative Example 1 as to conditions in spinning and subsequent operations. In Comparative Example 4, thread breakage or the like did not occur, and thus there was no problem in spinning, but in a drawing step, there was a case where single fibers were broken, and a spindle wound around a drawing roller.

Observation of a cross-section of the sea-island composite fiber showed that island components had a distorted round cross-section, and since the sea component polymer had such a low viscosity that it was not practical to use the sea component polymer with the pipe-type sea-island composite spinneret, two or more island components were fused together in some parts (five to ten island components). Accordingly, the average diameter of island component was about 1.5 μm, and the variation of diameter of island component was 16%, which is larger than that in Example 1. The above-mentioned breakage of single fibers in the drawing step may be ascribable to nonuniformity of the cross-section.

When from a test piece (knitted fabric) composed of the sea-island composite fiber, the sea component was removed in the same manner as in Example 1, thin fibers fuzzed out in some parts, and falling of thin fibers occurred during a step of treating the thin fibers. The test piece was inferior in bulkiness and stretchability, and had a reduced tactile impression as compared to Example 1. Observation of a cross-section of one thin fiber bundle showed that as in the case of Comparative Example 1, the cross-section had a height of 100 μm and a width of 380 μm, and thus bulkiness was much lower than that in Example 1. The results are also shown in Table 2.

Examples 7 to 9

Except that the distribution plate immediately above the nozzle plate was changed so that 5 (Example 7), 15 (Example 8) or 1,000 (Example 9) island components of side-by-side structure were formed on one sea-island composite fiber, the same procedure as in Example 2 was carried out to obtain a sea-island composite fiber. As a nozzle arrangement pattern on the distribution plate, the arrangement pattern in FIG. 5(*a*) was employed as in Example 2.

In these sea-island composite fibers, the diameter (D) of island component varied depending on the number of islands, and island components of side-by-side structure with a diameter of 9.5 μm in Example 7, 5.5 μm in Example 8 and 0.7 μm in Example 9 were formed. At the cross-section of any of the fibers, island components were regularly arranged, and the variation of diameter of island component was 5% or less, suggesting very high homogeneity.

Sea-island composite fibers were taken in the same manner as in Example 2, and formed into knitted fabrics, and sea components were removed to prepare test pieces composed of thin fibers. In these test pieces, falling of thin fibers did not occur as in the case of Example 2, and all the test pieces were excellent in quality.

It was found that the bulkiness and stretchability of these test pieces varied depending on the diameter of island component (fiber diameter of thin fiber), and were able to be controlled according to the purpose of the product. Specifically, the test piece of Example 7 in which fibers had a large diameter had higher stretchability in particular as compared to Example 2, and the test piece of Example 9 had reduced stretchability, but had a remarkably delicate tactile impression. The test piece of Example 8 was excellent in balance between bulkiness and stretchability, and could be widely developed as a high-performance textile in applications ranging from inners to outers. The results are shown in Table 3.

TABLE 3

| | | | Example 7 | Example 8 | Example 9 | Example 10 | Example 11 | Example 12 |
|---|---|---|---|---|---|---|---|---|
| Polymer | Island 1 | — | PET1 | PET1 | PET1 | PET1 | PET1 | PET1 |
| | Island 2 | — | PBT | PBT | PBT | PBT | PBT | PBT |
| | Sea | — | Copolymer PET1 | Copolymer PET1 | Copolymer PET1 | Copolymer PET1 | Copolymer PET1 | Copolymer PET1 |
| | S/I | — | 0.3 | 0.3 | 0.3 | 0.3 | 0.3 | 0.3 |
| Sea-island ratio | Island 1 | % | 35 | 35 | 35 | 15 | 14 | 56 |
| | Island 2 | % | 35 | 35 | 35 | 15 | 56 | 14 |
| | Island 1/Island 2 | — | 50/50 | 50/50 | 50/50 | 50/50 | 20/80 | 80/20 |
| | Sea | % | 30 | 30 | 30 | 70 | 30 | 30 |
| Sea-island composite fiber | Island component composite configuration | — | Bimetal | Bimetal | Bimetal | Bimetal | Bimetal | Bimetal |
| | Island component diameter (D) | μm | 9.5 | 5.5 | 0.7 | 0.3 | 1.3 | 1.3 |
| | Island component diameter variation | % | 4.5 | 4.5 | 4.5 | 4.5 | 5.0 | 4.1 |

TABLE 3-continued

| | | | Example 7 | Example 8 | Example 9 | Example 10 | Example 11 | Example 12 |
|---|---|---|---|---|---|---|---|---|
| | Conjugated part lengh (L) | μm | 3.2 | 1.8 | 0.2 | 0.1 | 0.2 | 0.2 |
| | L/D | — | 0.3 | 0.3 | 0.3 | 0.3 | 0.1 | 0.1 |
| | Fiber fineness | dtex | 104 | 104 | 104 | 60 | 104 | 104 |
| | Strength | cN/dtex | 4.0 | 4.0 | 3.9 | 2.9 | 3.7 | 3.8 |
| | Elongation | % | 38 | 36 | 34 | 30 | 30 | 38 |
| Ultrafine | Fiber fineness | dtex | 73 | 73 | 73 | 18 | 73 | 73 |
| fiber | Single filament fineness | dtex | 0.97 | 0.32 | 0.005 | 0.001 | 0.02 | 0.02 |
| | Strength | cN/dtex | 3.9 | 3.9 | 3.2 | 2.8 | 3.6 | 3.7 |
| | Elongation | % | 43 | 40 | 33 | 26 | 34 | 43 |
| | Bulkiness | $cm^3/g$ | 79 | 26 | 16 | 25 | 18 | 14 |
| | Stretching extension rate | % | 223 | 74 | 45 | 71 | 51 | 41 |
| Remarks | | | | | | | | |

Example 10

Except that the composite ratio of island component 1/island component 2/sea component was adjusted to 15/15/70 in terms of a weight ratio at a total throughput rate of 25 g/min, and the spinning speed and the draw ratio were changed to 3,000 m/min and 1.4, respectively, the same procedure as in Example 9 was carried out to obtain a sea-island composite fiber.

In the sea-island composite fiber, the island components had a further reduced diameter as compared to Example 9, namely the diameter of island component was 0.3 μm, but due to regular arrangement of island components, the variation of island components, and so on, a precise sea-island cross-section was maintained.

When the sea-island composite fiber of Example 10 was formed into a knitted fabric, and the sea component was removed, falling of thin fibers hardly occurred, and there was no problem as to quality. Observation of the test piece showed that the test piece had a three-dimensional spiral structure resulting from a side-by-side structure although the thin fibers had a very small fiber diameter of 0.3 μm. One thin fiber bundle had a cross-section having a height of 45 μm and a width of 140 μm, and one thin fiber bundle had lower apparent bulkiness as compared to Example 2. On the other hand, in a test piece prepared by combining four sea-island composite fibers and then removing the sea component for reducing a difference in total fineness, a bulky thin fiber bundle having very small gaps was obtained as compared to Example 2 due to the influence of the fiber diameter of thin fibers.

Based on the result described above, a test piece prepared by combining four sea-island composite fibers was evaluated for bulkiness and stretchability in Example 10, and the result showed that the test piece had relatively excellent characteristics. The results are also shown in Table 3.

Examples 11 and 12

Except that the composite ratio of island component 1/island component 2/sea component in terms of a weight ratio was changed to 14/56/30 (Example 11) or 56/14/30 (Example 12), the same procedure as in Example 2 was carried out to obtain a sea-island composite fiber.

It was found that in each of Examples 11 and 12, daruma-shaped island components having two recess portions were formed on a sea-island cross-section, the diameter (D) of island component was 1.3 μm, the length (L) of the joint section was 0.2 μm, and the ratio (L/D) was 0.1.

Each of these sea-island composite fibers was formed into a knitted fabric, and the sea component was removed to prepare a test piece. A cross-section of the test piece was examined in the same manner as in Example 1, and the result showed that on a cross-section of a thin fiber, a daruma-shaped cross-section as seen in the sea-island cross-section was maintained, and the ratio (L/D) was 0.1, and even after removal of the sea component, the polymer joint section was maintained.

It was found that these thin fibers had a structure different from that in Example 2, the thin fiber itself had a twisted and curved structure, and it was able to control the structure of thin fibers by changing the ratio of island component 1/island component 2. The results are also shown in Table 3.

Example 13

Polyethylene terephthalate in which 8.0 mol % of 5-sodium sulfoisophthalic acid was copolymerized (copolymerization PET 3, melt viscosity: 110 Pa·s) was used as the island component 1, PA 1 (melt viscosity: 120 Pa·s) used in Example 5 was used as the island component 2, copolymerization PET 1 (melt viscosity: 45 Pa·s) used in Example 5 was used as the sea component, and the spinning temperature was 280° C. A composite spinneret was used in which a distribution plate having an arrangement pattern as shown in FIG. 5(*b*) was provided immediately above a nozzle plate so that 250 island components having a sheath-core-type composite structure with the island component 1 forming a core part and the island component 2 forming a sheath part were formed per sea-island composite fiber (FIG. 4). A sea-island composite fiber was obtained by following Example 1 as to other conditions.

In the sea-island composite fiber, not only the sea component but also the core parts of island components were dissolved and removed by adjusting the treatment temperature in view of the weight before and after the treatment. A cross-section of the thin fiber was observed in the same manner as in Example 1, and the result showed that the thin fiber had a hollow cross-section which was hollowed at a part where the island component 1 had existed.

The thin hollow fibers were confirmed to have a lightweight feeling while having a delicate tactile impression specific to thin fibers, and have flexible and lightweight characteristics suitable for, for example, inner cottons of outerwear. The cross-section observation showed that thin fibers collapsed at the hollow part did not exist. This may be because the copolymerization polyethylene terephthalate used as the island component 1 had a dissolution rate different by a factor of about 1.4 from that of the copolymerization polyethylene terephthalate used as the sea component, and therefore the island component 1 existed in the core parts of thin fibers during removal of the sea component so that the thin fibers had resistance to an external force during the sea component removal step. It is thought that since the sea component had a lower viscosity as compared to the island component, stress applied in the fiber production step was borne by the ultimately remaining island component 2 so that the fiber structure of the island component 2 was highly aligned to give a favorable influence. The results are shown in Table 4.

TABLE 4

| | | | Example 13 | Example 14 | Example 15 |
|---|---|---|---|---|---|
| Polymer | Island 1 | — | Copolymer PET3 | PET1 | Copolymer PET3 |
| | Island 2 | — | PA1 | PS | PA1 |
| | Sea | — | Copolymer PET1 | Copolymer PET1 | Copolymer PET1 |
| | S/I | — | 0.4 | 0.3 | 0.4 |
| Sea-island ratio | Island 1 | % | 35 | 35 | 35 |
| | Island 2 | % | 35 | 35 | 35 |
| | Island 1/Island 2 | — | 50/50 | 50/50 | 50/50 |
| | Sea | % | 30 | 30 | 30 |
| Sea-island composite fiber | Island component composite configuration | — | Core-sheath | Core-sheath | Sea-Island |
| | Island component diameter (D) | μm | 1.4 | 1.6 | 1.4 |
| | Island component diameter variation | % | 5.4 | 4.2 | 5.4 |
| | Conjugated part lengh (L) | μm | 3.1 | 3.6 | 9.8 |
| | L/D | — | 2.2 | 2.2 | 7.0 |
| | Fiber fineness | dtex | 104 | 133 | 104 |
| | Strength | cN/dtex | 4.1 | 2.9 | 3.9 |
| | Elongation | % | 40 | 35 | 42 |
| Ultrafine fiber | Fiber fineness | dtex | 37 | 93 | 37 |
| | Single filament fineness | dtex | 0.02 | 0.02 | 0.02 |
| | Strength | cN/dtex | 4.0 | 2.8 | 3.8 |
| | Elongation | % | 40 | 27 | 41 |
| | Remarks | | Hollow structure | | Lotus hollow structure |

Example 14

Except that PET 1 used in Example 1 was used as the island component 1, polystyrene (PS, melt viscosity: 100 Pa·s) was used as the island component 2, the spinning temperature was 290° C., and drawing was performed at a ratio of 2.5 between rollers heated to 90° C. and 130° C., the same procedure as in Example 13 was carried out to obtain a sea-island composite fiber.

The sea-island composite fiber had a sea-island cross-section on which sheath-core-type island components with the island component 1 forming a core component and the island component 2 forming a sheath component were formed. It was confirmed that when the sea-island fiber was subjected to removal of the sea component, sheath-core-type thin fibers were formed without breaking the sheath component, and had excellent mechanical properties.

PS is an amorphous polymer, and therefore when the polymer is formed into fibers, generally fragile fibers are formed, and are thus difficult to use. In Example 14, however, polyethylene terephthalate bearing mechanical properties existed in the core part, and therefore although the thin fibers had a reduced fiber diameter of 1.6 μm, they had mechanical properties acceptable in practical use. In the thin fibers, a third component (functional agent or the like) can be added, and the retainability thereof can be improved by taking advantage of not only a specific surface area specific to the fiber diameter but also the amorphousness of PS. As for stainability, amorphous PS is stained in a dark color, and thus color development which is one of the concerns for conventional thin fibers can be considerably improved. The results are also shown in Table 4.

Example 15

Except that while the combination of polymers was the same as that in Example 13, a composite spinneret was used in which a distribution plate having an arrangement pattern as in FIG. 5(*c*) was provided immediately above a nozzle plate (FIG. 4), the same procedure as in Example 13 was carried out to obtain a sea-island composite fiber.

In the obtained sea-island composite fiber, 250 island components of sea-island structure with the island component 1 forming island parts (10 island parts) and the island component 2 forming a sea part were formed per one sea-island composite fiber on a cross-section of the sea-island composite fiber.

The sea-island composite fiber was formed into a knitted fabric, and the sea component and the island component 1 were dissolved and removed by the method described in Example 13 to obtain thin fibers having a plurality of lotus root-like hollow cross-sections on a cross-section of the thin fiber. The thin fibers had a specific hollow structure, and were therefore hardly collapsed even when a force was applied in the cross-section direction. Thus, it was found that thin hollow fibers having resistance to compression deformation were obtained. The results are also shown in Table 4.

INDUSTRIAL APPLICABILITY

The sea-island composite fiber can be formed into a various fiber products by converting the sea-island composite fiber into a variety of intermediates such as fiber winding-up packages, tows, cut fibers, cottons, fiber balls, cords, piles, woven/knitted fabrics and nonwoven fabrics, and subjecting the intermediates to a sea component removal treatment or the like to generate thin fibers. The sea-island composite fiber can also be formed into fiber products by partially removing the sea component in an untreated state, or performing a island component removal treatment or the like. The fiber products mentioned here can be used in living article applications such as general clothes such as jackets, skirts, pants and underwears, sportswears, clothing materials, interior products such as carpets, sofas and curtains, vehicle interior products such as car seats, cosmetics, cosmetic masks, wiping cloths, and health equipment; environmental/industrial material applications such as polishing cloths, filters, harmful substance removing products; and separators for batteries, and medical applications such as sutures, scaffolds, artificial blood vessels, and blood filters.

The invention claimed is:

1. A sea-island composite fiber in which island components are interspersed in a removable sea component on a fiber cross-section, wherein each of the island components has a composite structure formed with a combination of two different polymers joined together in side-by-side form, wherein the combination of two different polymers 1) has a viscosity difference of 10 Pa·s or more, and 2) is selected from the group consisting of polyethylene terephthalate/polybutylene terephthalate, polyethylene terephthalate/polytrimethylene terephthalate, polyethylene terephthalate/thermoplastic polyurethane or polybutylene terephthalate/polytrimethylene terephthalate, the island component has a diameter of 1.0 μm to 5.0 μm, a ratio (L/D) of a length (L) of the joint section of the island component and a diameter (D) of the composite island component is 0.1 to 1.0, a ratio (S/I) of a viscosity (I) of the island component polymer and a viscosity (S) of the sea component polymer is 0.3 to 0.8, the viscosity (I) of the island component polymer means the highest melt viscosity of the melt viscosities of two or more island component polymers, and wherein the sea component polymer is a polyester in which 3 mol % to 20 mol % of 5-sodium sulfoisophthalic acid and 5 wt % to 15 wt % of polyethylene glycol having a molecular weight of 500 to 3,000 are copolymerized.

2. The sea-island composite fiber according to claim 1, wherein a variation of diameter of island component is 1.0 to 20.0% in the island component with two or more different polymers joined together.

3. The sea-island composite fiber according to claim 1, wherein a composite ratio in the island component is 10/90 to 90/10 in the island component with two or more different polymers joined together.

4. A conjugate thin fiber obtained by removing the removable sea component from the sea-island composite fiber of claim 1.

5. The conjugate thin fiber according to claim 4, wherein the conjugate thin fiber is side-by-side in which a fiber cross-section in a direction vertical to the fiber axis has a structure with two polymers bonded together, and the conjugate thin fiber has a single fiber fineness of 0.001 to 0.970 dtex and a bulkiness of 14 to 79 $cm^3/g$.

6. The conjugate thin fiber according to claim 5, having a stretch extensibility of 41 to 223%.

7. A fiber product formed at least partially by the sea-island composite fiber of claim 1.

8. A fiber product formed at least partially by the conjugate thin fiber of claim 4.

* * * * *